United States Patent [19]

Van den Berg et al.

[11] Patent Number: 4,909,143

[45] Date of Patent: Mar. 20, 1990

[54] MULTICOLOR, ROTARY SCREEN PRINTING MACHINE AND A STEPPED VARIABLE GEAR DRIVE FROM A MACHINE OF THIS TYPE

[75] Inventors: Robert J. Van den Berg, Ewijk; Cornelis A. Toonen, Cuyk; Gerardus H. Van Mondfrans, Sambeek, all of Netherlands

[73] Assignee: Stork Brabant B.V., Boxmeer, Netherlands

[21] Appl. No.: 254,824

[22] Filed: Oct. 7, 1988

[30] Foreign Application Priority Data

Oct. 9, 1987 [NL] Netherlands ..... 8702408
Oct. 9, 1987 [NL] Netherlands ..... 8702410
Oct. 9, 1987 [NL] Netherlands ..... 8702411

[51] Int. Cl.[4] ..... B41L 13/00
[52] U.S. Cl. ..... 101/118
[58] Field of Search ..... 101/115, 116, 117, 118

[56] References Cited

U.S. PATENT DOCUMENTS

| | | | |
|---|---|---|---|
| 1,629,564 | 5/1927 | White . | |
| 3,291,044 | 12/1966 | van der Winden | 101/118 |
| 3,304,860 | 2/1967 | van der Winden | 101/116 |
| 3,313,232 | 4/1967 | van der Winden | 101/118 |
| 3,420,167 | 1/1969 | van der Winden | 101/116 |
| 3,523,488 | 8/1970 | Robinson | 91/180 |
| 3,675,571 | 7/1972 | Vertegaal | 101/115 |
| 3,718,086 | 2/1973 | Vertegaal | 101/115 |
| 3,774,534 | 11/1973 | Ichinose | 101/116 |
| 3,892,176 | 7/1975 | van der Winden | 101/116 |
| 3,903,792 | 9/1975 | Vertegaal | 101/118 |
| 3,995,551 | 12/1976 | Mitter | 101/118 |
| 4,006,683 | 2/1977 | Vertegaal | 101/115 |
| 4,030,411 | 6/1977 | Zimmer | 101/118 |
| 4,114,534 | 9/1978 | Kudlich et al. | 101/115 |
| 4,256,037 | 3/1981 | Vertegaal | 101/115 |

FOREIGN PATENT DOCUMENTS

| | | |
|---|---|---|
| 133143 | 8/1971 | Netherlands . |
| 1524159 | 9/1978 | United Kingdom . |

*Primary Examiner*—Eugene H. Eickholt
*Attorney, Agent, or Firm*—Kenyon & Kenyon

[57] ABSTRACT

Multicolor rotary screen printing machine comprising a number of parallel cylindrical stencils, pairwise rotatably suspended on both sides of a transverse beam and cooperating with a travelling printing blanket; the stencils and the blanket are driven by a common motor, mounted externally of the machine, said motor driving an intermediate shaft supported upon the frame of the machine, from which shaft the stencils are jointly driven through a stepped gear drive and hereafter individually through a series of toothed wheels and a planetary driving mechanism.

22 Claims, 22 Drawing Sheets

XVI
XVI

MULTICOLOR, ROTARY SCREEN PRINTING MACHINE AND A STEPPED VARIABLE GEAR DRIVE FROM A MACHINE OF THIS TYPE

The invention relates to a multicolor, rotary screen printing machine comprising a main frame provided with a number of parallel cylinder stencils which are rotatably mounted herein and which are each able to act together with a dye feed device and with a squeegee, further provided with a continuous supporting belt for the formation of a horizontal operative path section for the material to be printed, in which the stencils are fitted on both ends in an end ring rotatably supported in an assembly head which forms part of a beam lying transversely above the supporting belt. A device of this type is known in a first embodiment from Netherlands Pat. Nos. 125.119, 136.019 and 141. 428 and in a more recent embodiment from Netherlands Pat. Nos. 132.416, 133.143 and 134.267; see also British Pat. No. 1,524,159 and U.S. Pat. No. 3,291,044.

Initially, manual adjustment was predominantly used in these screen printing machines, not only for positioning the individual stencils but also for the further setting up and preparation for use of the entire machine. Gradually there has been a trend towards mechanizing and, if possible, even automating the requisite adjustment operations, but to a significant extent the skill and the experience of the operators continue to play a major role. Current development is, however, increasingly focussing on the design of machines for which the operation and the adjustment can be carried out by staff who, although expert, are not necessarily experienced, with, at the same time, a reduction in the time required for all of these operations. Making and keeping the screen printing machine ready for use must also be as simple as possible.

In the earlier mentioned U.S. Pat. No. 3,291,044 a description is given of a provision for adjusting the position of the guiding devices for the supporting belt (also, in fact, called: printing blanket). Each guide device can be shifted, via a roller lever, between an uppermost operation position and a lowermost non-operating position, in which last-named position the supporting belt is free from any contact with the cylinder stencils located thereabove.

A further object of the invention a is to make it possible to very accurately adjust the position of the supporting belt, not only for a single stencil diameter but for a series of different diameters, as is the case with cylinder stencils of different designs and of different manufacture.

Moreover, reference is made to applicant's earlier patent application NL 0511. transverse beams used in the superstructure described therein each carry one cylindrical stencil which is held in a fixed position relative to the bridge. The adjustment of the position of the stencil relative to the blanket and to the web of material to be printed is effected by moving the entire bridge with the associated stencil. For this purpose one end of each beam is fitted on the frame so as to be movable in a horizontal plane. The attachment of the stencil to the beam is effected by means of detachable assembly heads hooked into the beam, one of which is fixed relative to the beam in operation and the other can be moved longitudinally along the beam, by means of, for example, a piston-cylinder device, to enable variations in the length of the stencil to be absorbed and the stencil to be put under tension.

A drawback of the known screen printing machine is that each stencil has to be provided with its own transverse beam because the individual adjustment of the position of each stencil would otherwise not be possible. The beams somewhat obstruct the operators view upon the web of material to be printed so that it is difficult to determine whether during operation the print patterns of the various stencils fit together. It is further disadvantageous that the beam is movable: as a result the beam can develop play in operation, which makes accurate positioning of the stencils relative to one another very difficult.

The invention aims to provide a rotary screen printing machine which is improved relative to the prior art by its simplicity in operation, adjustment and maintenance. These objectives are achieved by a combination of the following structural features:

- a single motor positioned outside the main frame, directly driving on intermediate shaft located inside the frame and connected to the stencils and the supporting belt;
- guiding devices having common adjusting means for determining the level of the operative path section of the supporting belt;
- the transverse beams are fixed upon the main frame and are provided at both ends with two opposite extensions in transverse direction for the mounting of the stencils, said extensions comprising adjustable mounting means for accommodating an assembly head.

An important and continually recurring question is the manner in which the stencils are placed in their seating (i.e. in the abovementioned assembly heads). Depending on the relationship between stencil diameter and the mutual distance, on the one hand, and the position of the particular stencil in the series of stencils located adjacent to one another, on the other hand, the design of each stencil must assume a very accurately determined angular position, such that during operation the printing patterns of the series of stencils precisely coincide or fit together. The first coarse adjustment of this angular position and the subsequent fine adjustment have always been the subject of a great deal of care on the part of the screen printing machine operators.

In an important embodiment of the present screen printing machine, the adjustment operation is greatly simplified when:

- the intermediate shaft has a slip-free (formschlüssig) transmission with a stepped variable gear drive for the stencils and with a drive box for the supporting belt;
- the exit shaft from the variable gear drive is connected to a common main drive shaft, located in the longitudinal direction of the machine, for the stencils, which shaft is coupled via a series of toothed wheels with a planetary driving mechanism to each of the stencils.

As a result of these measures, a series of adjustments can already be carried out and set during the test run of the machine in the factory, such that when the machine is delivered to the user and assembled a large number of adjustments previously required are no longer needed or can be carried out considerably more quickly, so that also when the design is changed the customary down times can be reduced and the productive time of each machine can increase in terms of percentage.

The word "formschlüssig" is an untranslatable term for a fixed positional relationship between two or more elements such that the movement (or shifting) of one element results in an invariable movement or shift, to be predetermined, of the other element of elements.

A further advantage is that, by using a planetary driving mechanism in the drive for the stencils, the angular position of each stencil individually can be adjusted even during operation. By the means a rough adjustment can first be obtained and then the fine adjustment. This means that all of the stencils can be positioned in a uniform manner in the machine and the angular position of each stencil can then be adjusted. Both the coarse and the fine adjustment can be carried out by means of the planetary driving mechanism. Moreover, it is possible to react quickly to any small defect which may arise in the printing result.

The entire construction can be accommodated in the upright outer ends of each beam, which promotes the compactness and the clear arrangement of the machine. Preferably, the planetary driving mechanism for each stencil is made up of two coaxial and virtually identical sun wheels which have only one or two teeth difference between them, which two sun wheels mesh with an elastically deformable annular planet wheel, as known per se from NL Pat. No. 140.946. According to the invention the two sun wheels are incorporated in the drive of the stencil, while the planet ring is connected to an adjusting motor, provided with a pulse counter. As indicated above, the angular position of each stencil can be individually successively coarsely adjusted and then finely adjusted by means of the planetary driving mechanism. The coarse adjustment is effected by using a high revolution in the adjusting motor. The fine adjustment is effected at a low rotation speed and by a stepwise rotation with the aid of the pulse counter. Once the data for this adjustment have been stored in a computer memory, the position setting of the stencils can be achieved entirely automatically if the same design is used again. There is no longer any need to work with marks in the end ring and in the assembly head. A fixed point on the stencil itself (the so-called PICO point) then suffices.

The invention also relates to the stepped variable gear drive from the screen printing machine described above. This variable gear drive is characterized in that the tooting consists of a pinion and a toothed sector engaging in this, the toothed sector of which is attached to a clutch shaft, located in the casing, onto which the shift arm is attached and onto which, likewise, an assembly lever is pivotably positioned, the pinion being attached to a second shaft, likewise rotatably bearing-mounted in the said lever, of an adjusting motor suspended on this assembly lever is movably connected, via an elastic link, to the frame. A driving mechanism designed in this way is outstandingly suitable for automatic shifting when the said adjusting motors are preprogrammed.

For the automatic shifting of a stepped variable gear drive of this type, it is advantageous if an auxiliary motor is present which is connected, via a freewheel clutch, to the exit shaft of the gear drive, which auxiliary motor is designed with a pulsating excitation during shifting to another velocity ratio for synchronizing the sliding claw couplings of the variable gear drive. This auxiliary motor makes engagement of the slidable claw couplings considerably easier.

An embodiment of the screen printing machine according to the invention in which the level of the horizontal path section of the supporting belt is determined with the aid of means for adjusting the position of the guiding devices for the belt (vide U.S. Pat. No. 3,291,044), the adjustment means for the guiding devices of the supporting belt consist of a series of cam faces which are coupled together and provided with a common adjustment device, each cam face cooperating with a follower which is directly coupled to a belt guiding device.

The use of cam faces makes a very accurate positioning possible with which an accurate adjustment of the position of the horizontal path section of the supporting belt on the diameter of the cylinder stencils used is possible. The contact pressure between the stencils and the supporting belt can be maintained accurately at the desired figure in this manner.

For the rapid and expedient lowering of the horizontal path section of the supporting belt a pneumatic lifting device is present according to the invention between each follower allied to a cam face and the associated belt guiding device, which lifting device is constructed with two end positions for raising the belt guiding device to its operating position and lowering said device to a position in which the supporting belt runs free of the stencils.

Object of the invention is to overcome this drawback. For this purpose, a screen printing machine according to the invention is characterized in that the ends of each bridge are extended in the transverse direction on either side and in that fasteners for mounting a stencil holder are located in each extension.

It is finally observed that the tensioning of a stencil mounted on only one side of its transverse beam, may generate a bending force in the beam which cannot be compensated. This drawback is also overcome in the screen printing machine according to the present invention by means of the opposite extensions on both ends of each beam. Consequently the web of material to be printed is more easily visible and checking of the printing result becomes more easy.

The invention is illustrated in more detail with the aid of the drawing, which first gives an overall view of the entire machine and then of the most important elements thereof.

FIGS. 13 and 14 are, respectively, a front view and a side view of the outside of the variable gear drive according to FIG. 12.

FIG. 15 is a detail from FIG. 13 on an enlarged scale.

FIG. 16 is a cross-section, also on an enlarged scale, along the line XVI—XVI in FIG. 13.

Figure 25:
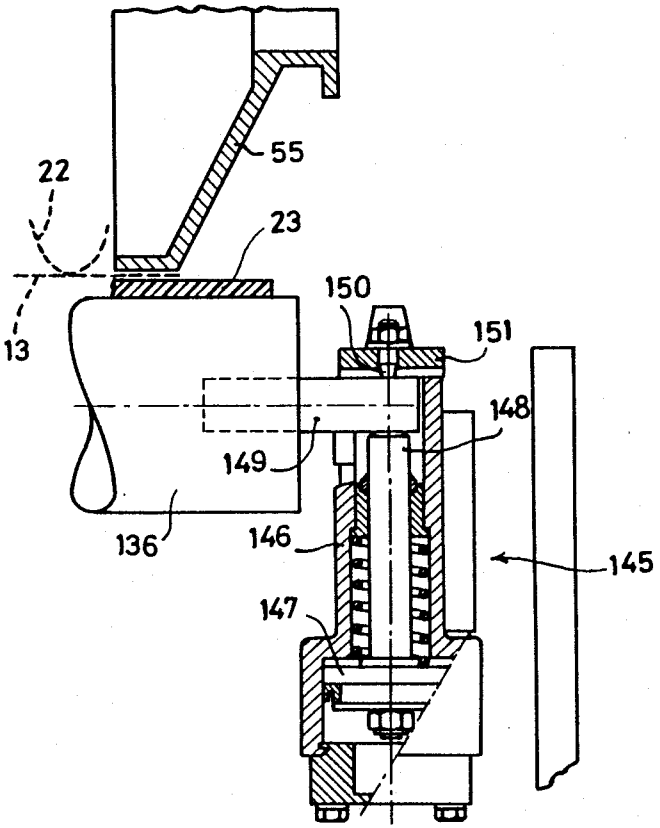
Figure 24:
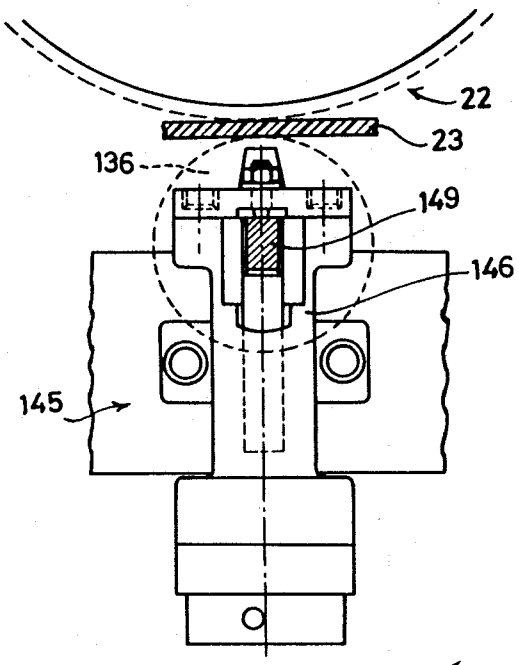

FIGS. 24 and 25 give an overall view and a cross-section respectively of the pneumatic means (also visible in FIGS. 2 and 3) for raising and lowering the supporting belt.

Figure 26:
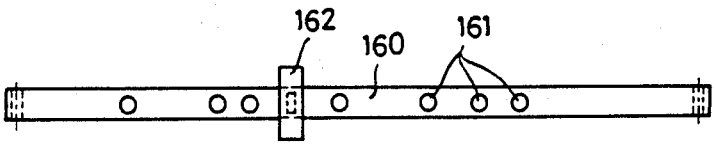

FIG. 26 is a part of the means for adjusting the level of the supporting belt.

Figure 27:
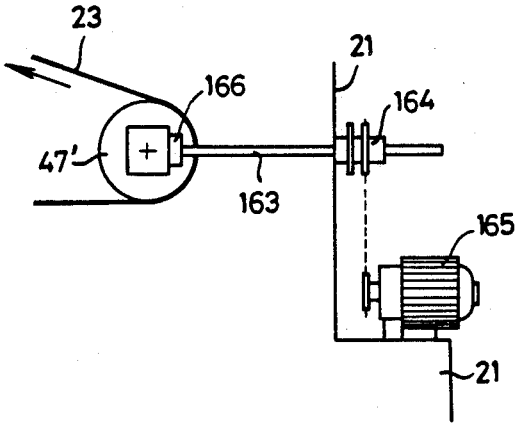

FIG. 27 shows return roller of the supporting belt provided with tension means.

Figure 28:
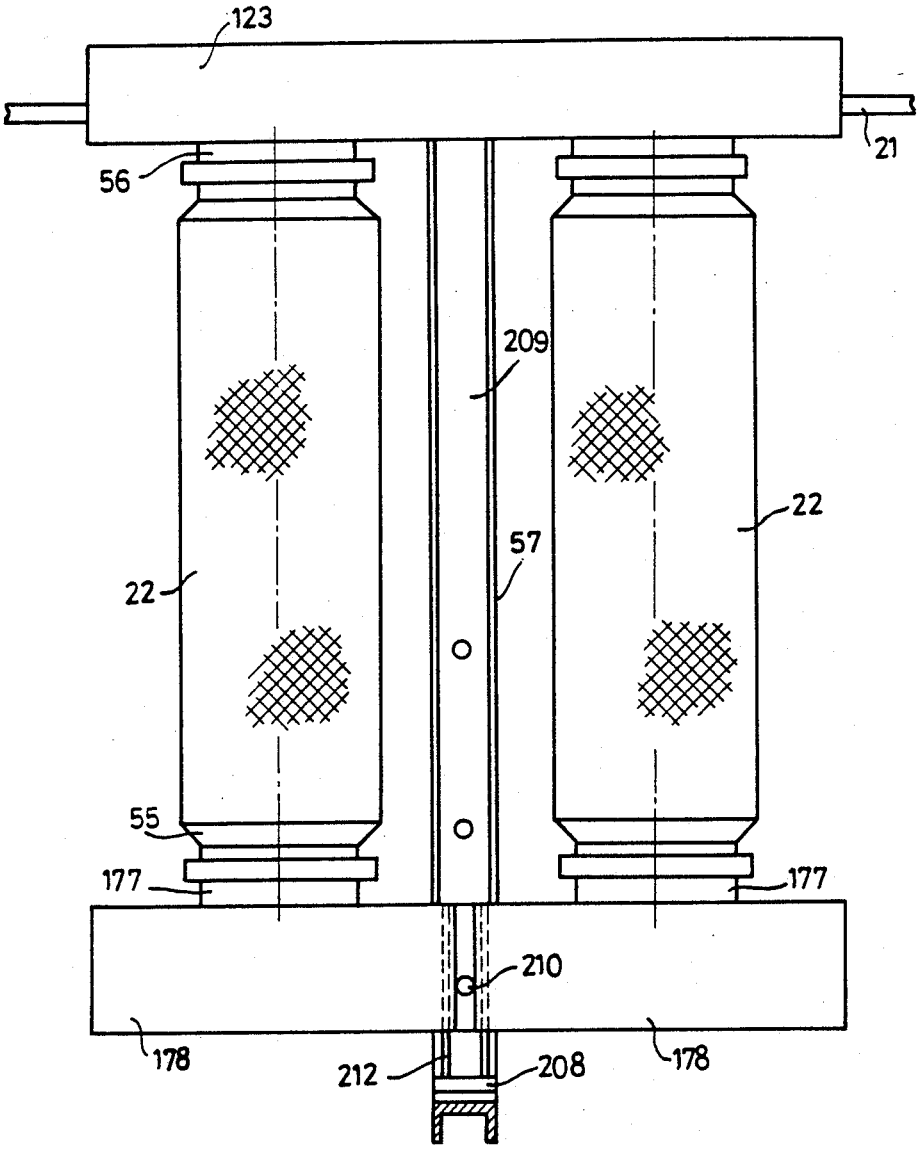

FIG. 28 shows a vertical top view of a transverse beam according to the invention, with extensions for the assembly heads and stencils.

Figure 29:
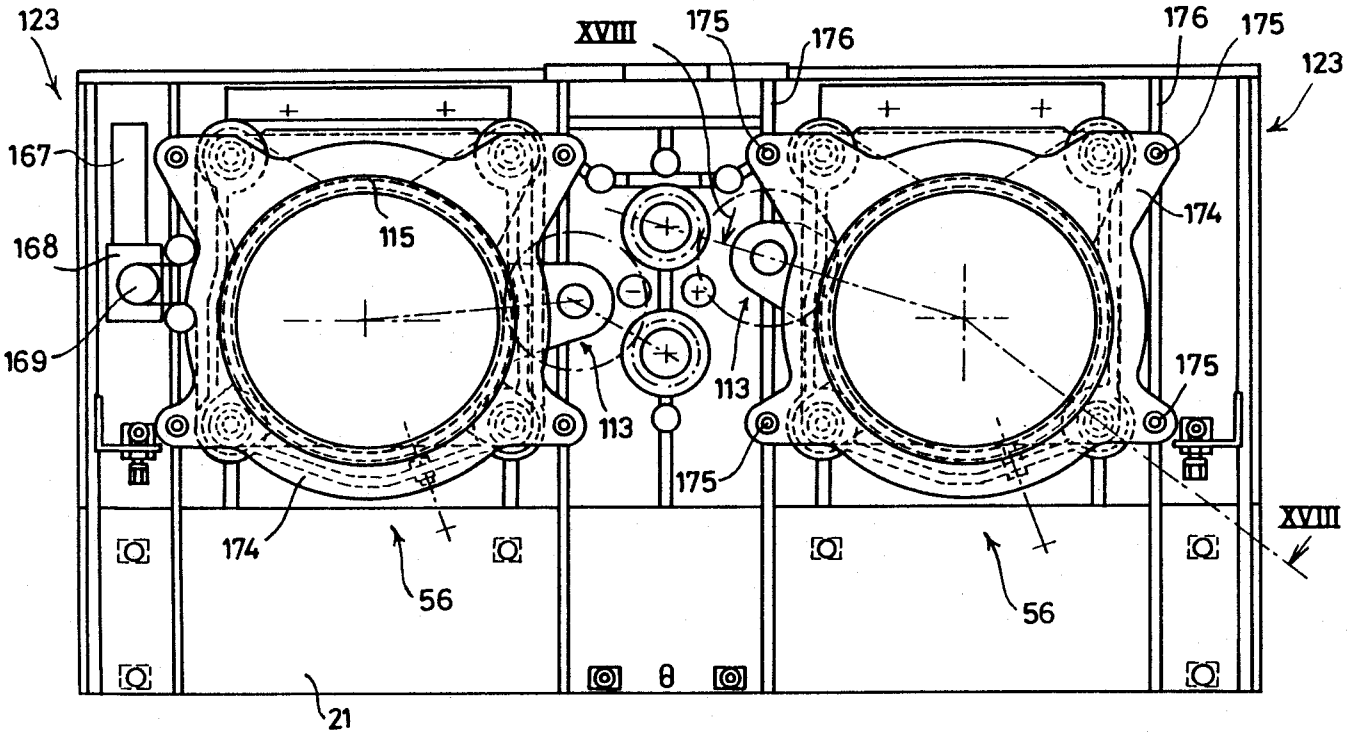

FIG. 29 shows a horizontal view of the beam extensions and assembly heads on the drive side of the screen printing machine.

Figure 6:
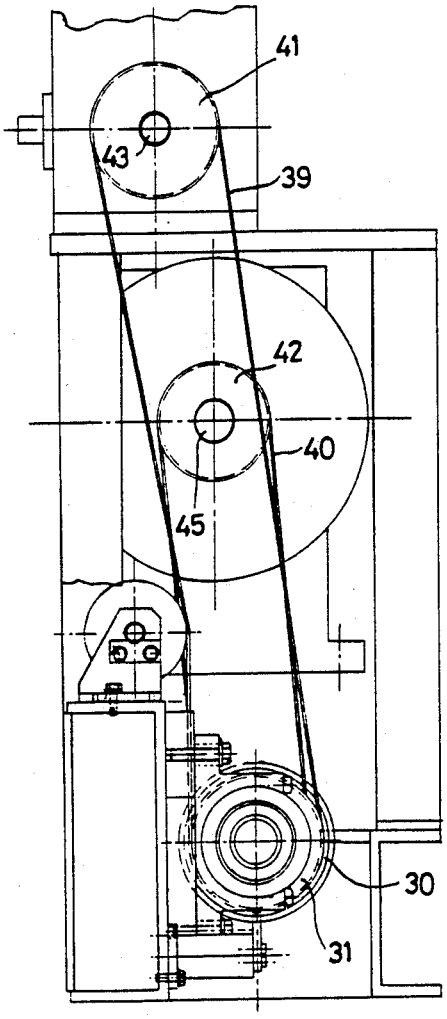
Figure 30:
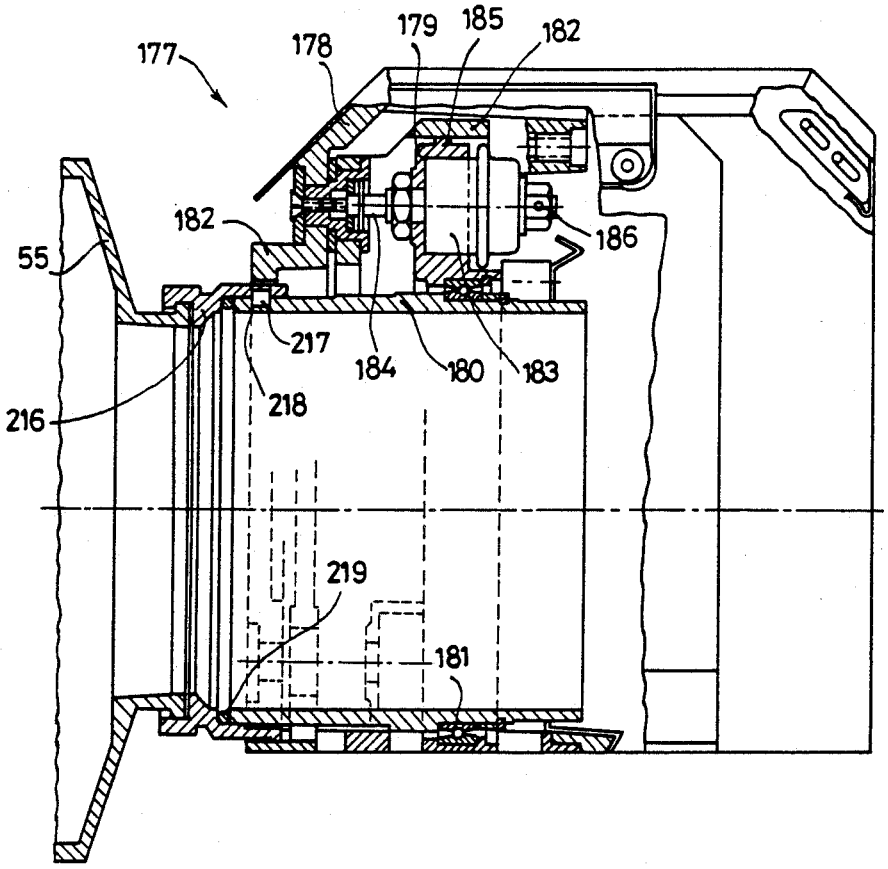
Figure 37:
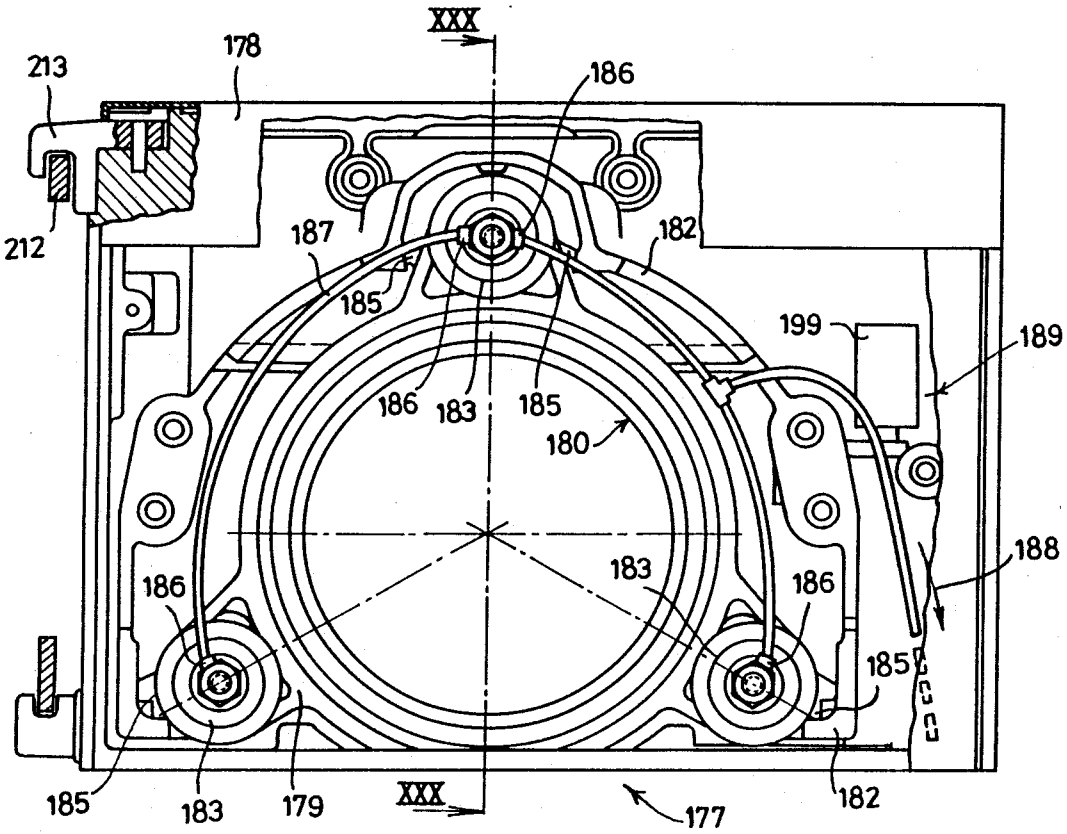

FIG. 30 shows a beam extension with assembly head on the pump side of the screen printing machine, in a section along V—V in FIG. 6.

FIG. 31 shows a horizontal view in the axial direction of the stencil on the beam extension with assembly head from pump side.

Figure 32:
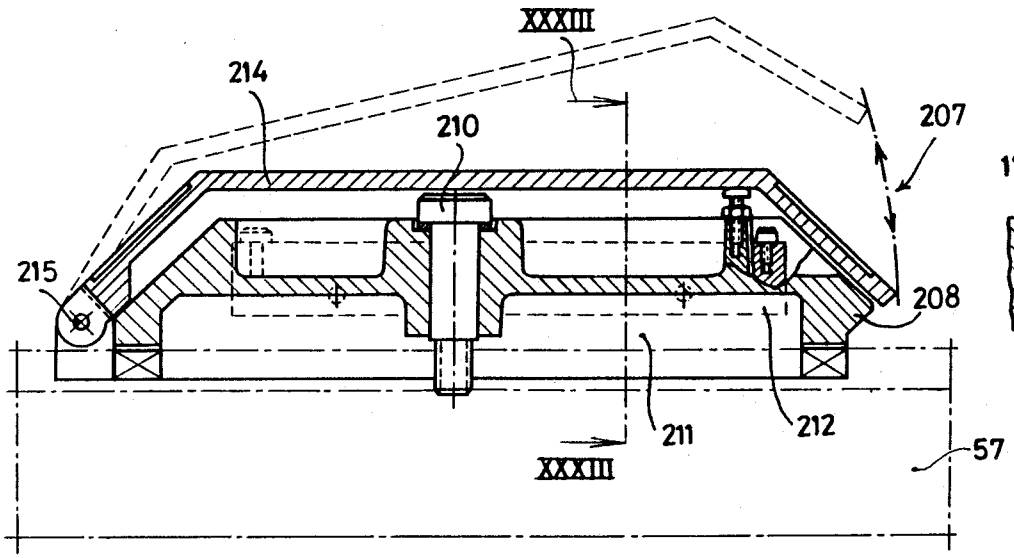

FIG. 32 shows a cross-section of a cradle with which a double-sided extension can be attached to a transverse beam, seen parallel to the direction of movement of the web to be printed.

Figures 5, 7:
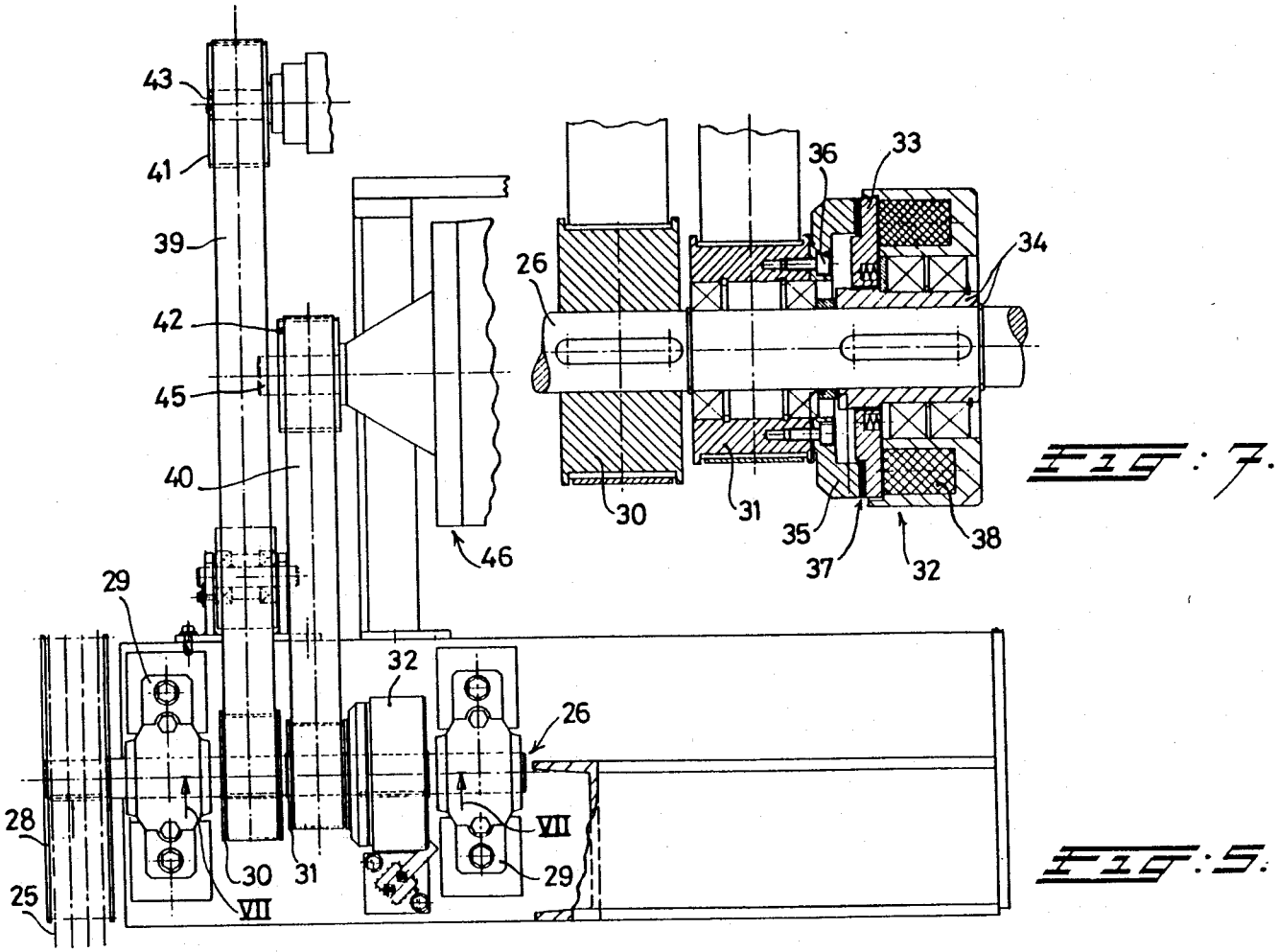
FIGS. 5 and 6 show, respectively, a front view and a side view of the combined drive for the stencils and for the supporting belt.
FIG. 7 is a cross-section on an enlarged scale along the line VII—VII in FIG. 5.
Figure 33:
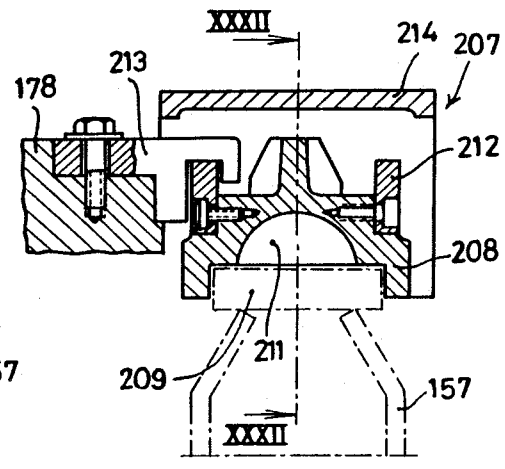

FIG. 33 shows a section over VIII—VIII in FIG. 7.

Figure 34:
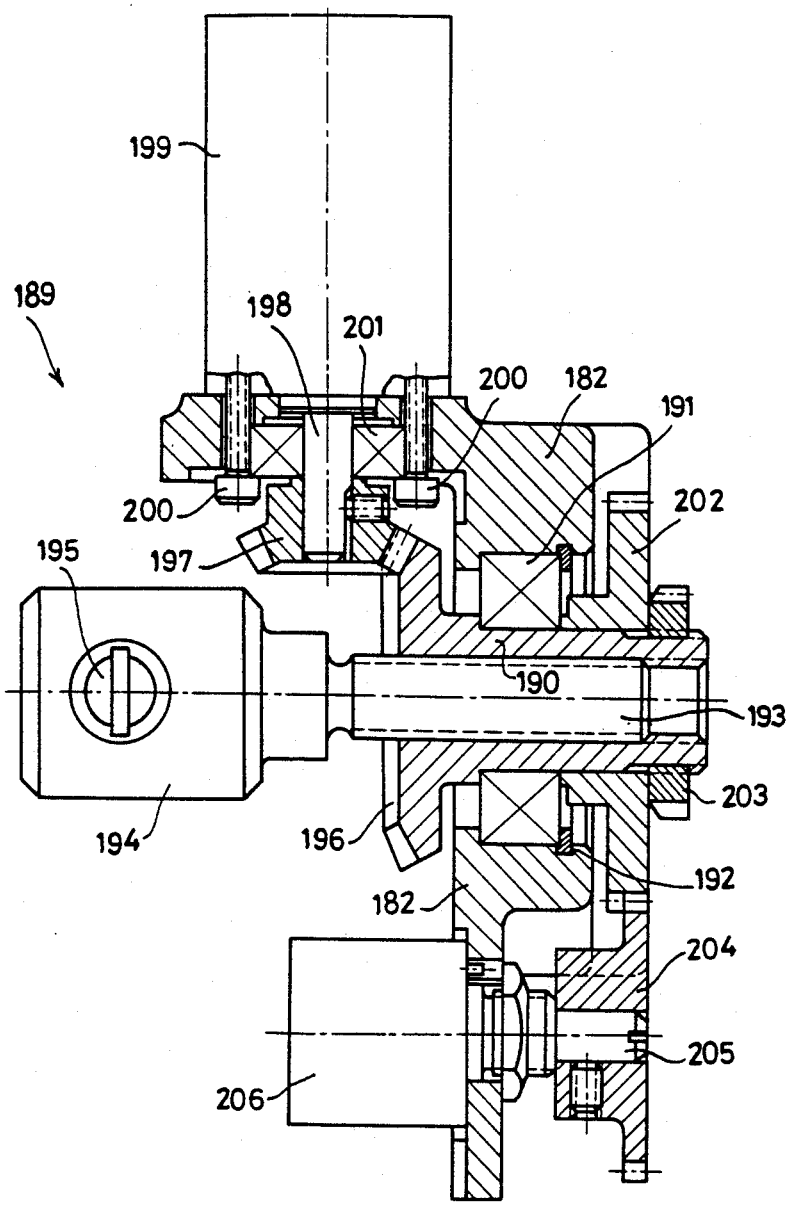

FIG. 34 shows a horizontal view of an installation for moving an assembly had on the pump side in the direction of movement of the web to be printed.

Figure 1:
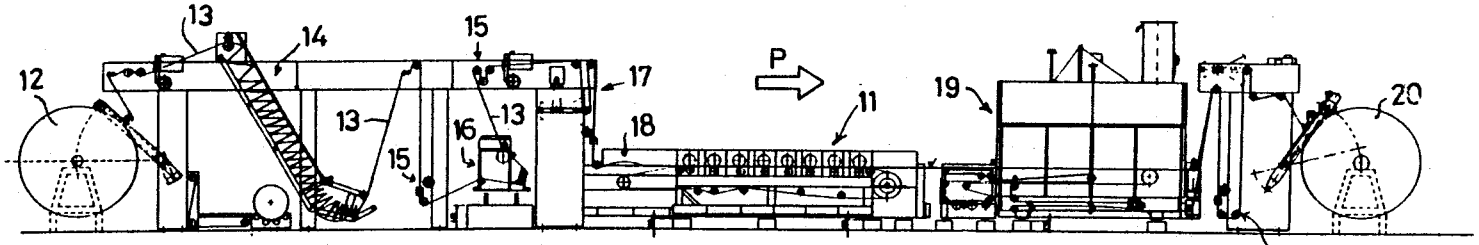
FIG. 1 is a rear view of the entire installation with on the left hand side, the feed for the cloth to be printed and, on the right hand side, a drying device for the printed cloth and a device for rolling the cloth dried in this way.

As can be seen in FIG. 1, the screen printing machine 11 positioned in the middle of this figure can form part of a more extensive printing installation which is provided on the left hand side with a stock roll 12 of a web 13 to be printed. This web passes through a schematically indicated inclined collecting tube or temporary buffer 14, which has, at the bottom, a lead through for the web 13. The web then passes a number of guide rollers 15 and a pretreatment device 16 and finally a tension adjuster 17, after which the web 13 enters the screen printing machine 11 via a curved surface 18. This machine is designed with eight rollers so that the web 13 can be printed with eight different colors or color shades. After passing through the screen printing machine 11, the web 13 passes through a drying device or steamer 19 to fix the colors applied. Finally, the web is again fed along a number of guide rollers 15 to be wound, ultimately, on a stock roll 20. The direction of movement of the web 13 is indicated by an arrow P. It should be pointed out that the loops of web shown in the collecting tube 14 are only temporary since the web 13 runs taut through the tube 14 during the actual printing stage, as explained in more detail at the end of this description.

Figure 2:
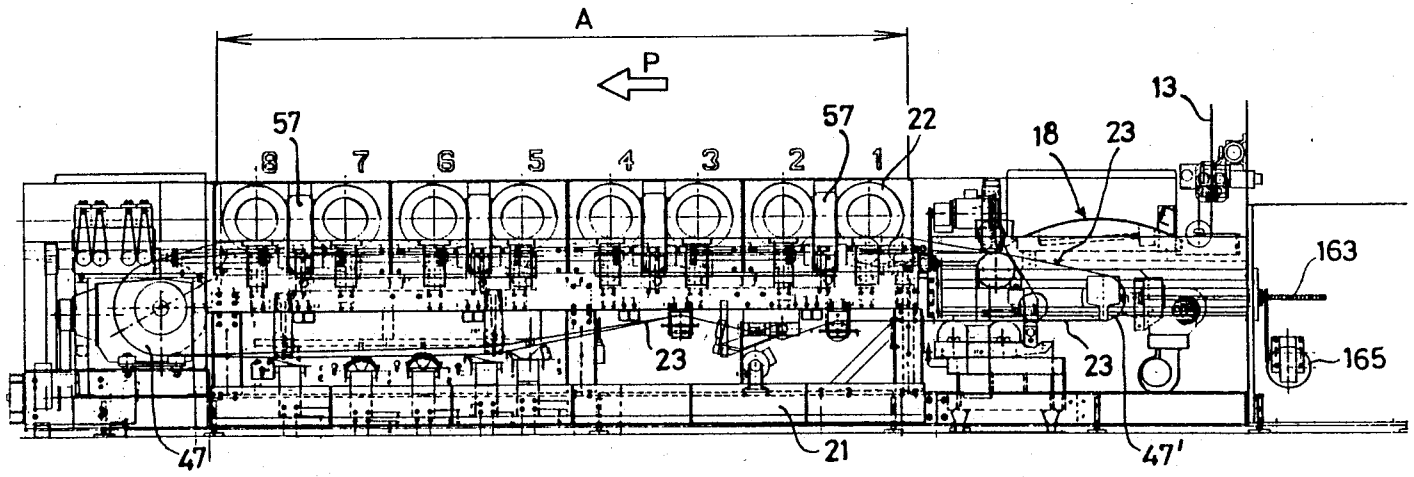
FIG. 2 is a front view of the central section of FIG. 1, i.e. the multi-color, rotary screen printing machine, seen from the drive side (in contrast to the so-called pump side shown in FIG. 1), the casing of the machine having been removed to render visible the internal details.
Figure 3:
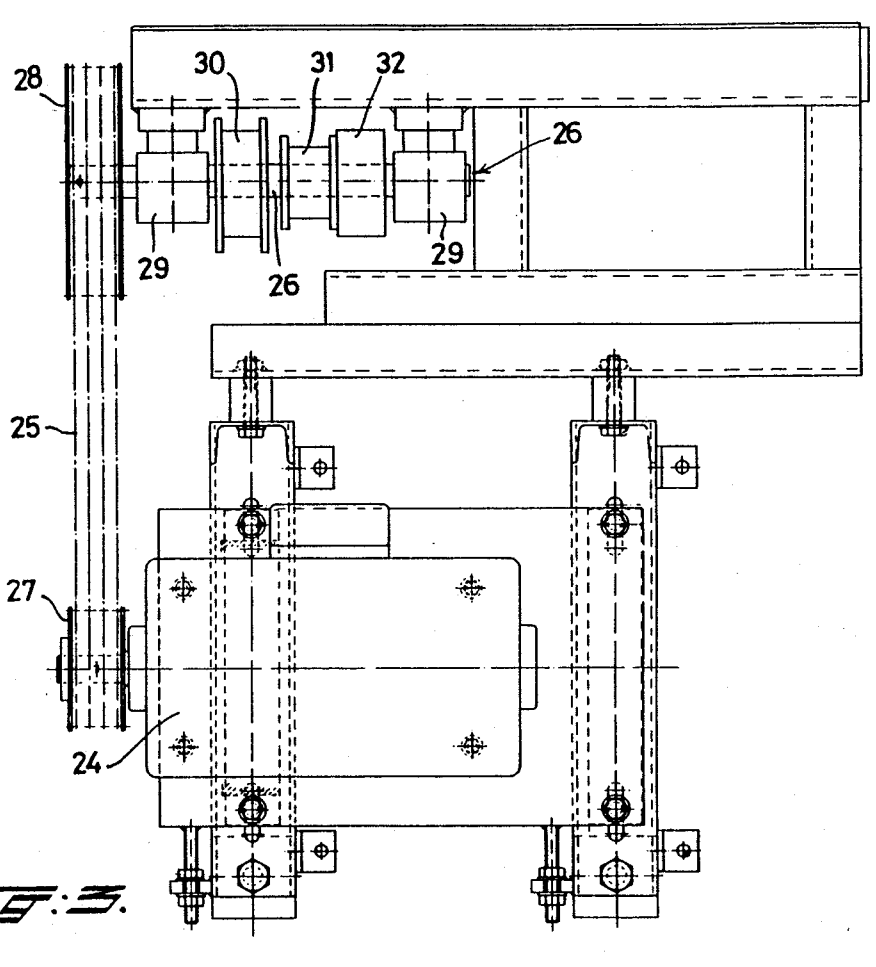
FIGS. 3 and 4 show, on an even larger scale, a top view and a side view respectively of the main drive of the machine.
Figure 4:
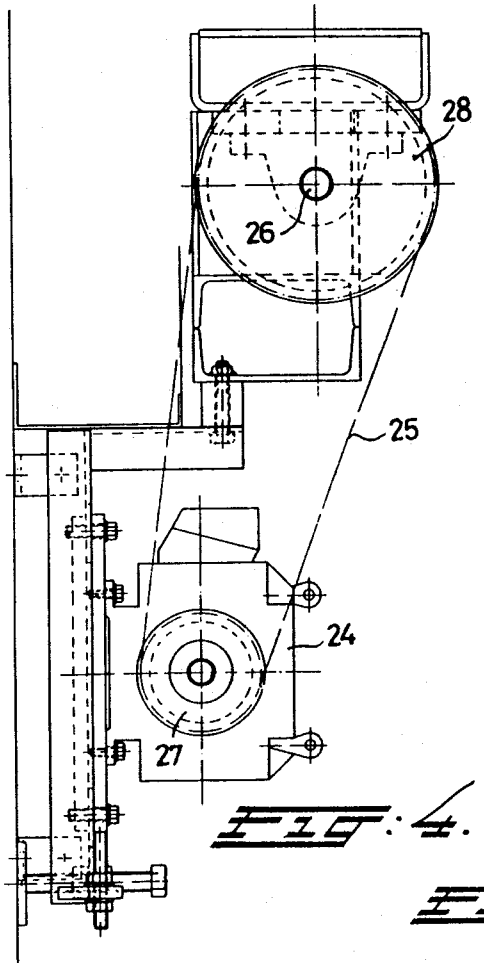

FIG. 2 shows a more detailed picture of the screen printing machine 11 from FIG. 1, whereby it must be pointed out that FIG. 1 is a view from the pump side and FIG. 2 from precisely the opposite drive side. Therefore, the arrow P in FIG. 2 points in the opposite direction to the same arrow P in FIG. 1. The machine 11 is constructed of a main frame 21 provided with a number of parallel cylinder stencils 22 which are bearing-mounted herein in a rotatable manner and are provided with a sequence number 1–8 in FIG. 2. These stencils can each act in conjunction with a dye feed device (not shown) and with a squeegee (likewise not shown). Devices of this type belong to the state of the art, such as, for example, described in the abovementioned British Pat. No. 1.524.159. The stencils 22 are located above a continuous supporting belt 23 for the material web 13 to be printed. The screen printing machine also contains means, which will be described in more detail below, for driving both the stencils 22 and the supporting belt 23. Furthermore, there are means, which will likewise be explained in more detail below, for positioning the individual stencils 22 in order to bring these accurately into rapport with one another.

An initial new element from the screen printing machine according to the invention is constituted by the means shown in FIGS. 3–6 for driving both the stencils 22 and the supporting belt 23. These means are constituted by a single motor 24, which is located outside the main frame 21 and drives an intermediate shaft 26, located inside the frame 21, directly via the belts 25. For this purpose, the motor 24 is provided with a pulley 27 and the intermediate shaft 26 carries a pulley 28 firmly connected thereto. The intermediate shaft 26 is supported by two bearings 29 and forms the driven shaft from which both the stencils 22 and the supporting belt 23 are driven at a constant velocity ratio.

Between these two bearings 29, the intermediate shaft 26 is provided with an initial toothed pulley 30, firmly attached thereto. A second pulley 31, which is also toothed, is rotatably mounted on bearings on the shaft 26. The coupling between this pulley 31 and the intermediate shaft 26 is effected by means of a magnetic toothed coupling 32, provided with an intermediate disk 33 which can be slid axially. This disk has a slidable spline connection to a hub 34, which is firmly attached to the intermediate shaft 26, but is pressed by several springs against a coupling flange 35. This flange, which is fixed with bolts 36 to the pulley 31, is provided with a similar toothed face of the intermediate disk 33. The coupling 32 is, finally, also provided with an electromagnet 38 which can be energized.

During normal operation of the screen printing machine 11 the two pulleys 30 and 31 are coupled with the intermediate shaft 26 and the electromagnet 38 is inoperative. The rotation of the intermediate shaft 26 is then transmitted, via the hub 34, the intermediate disk 33, the toothed coupling face 37, the coupling flange 35 and the bolts 36, to the second pulley 31. The pulleys 30 and 31 cooperate with a toothed belt 39 and, respectively, 40 to drive a toothed pulley 41 and, respectively, 42 (see FIGS. 5 and 6). The aim in using the toothed coupling 32 and the toothed belts 39 and 40 is to obtain a slipfree (formschlüssig) transmission to both the stencils 22 and the supporting belt 23. During the brief interruption in the operation of the screen printing machine 11, the electromagnet 38 is energized so that the intermediate disk 33 is attracted and the toothed face 37 is disengaged. As a result, there is no longer any driving connection from the intermediate shaft 26 to the second pulley 31 and the supporting belt (with the material web 13 thereon) stands still, although the stencils 22 continue to rotate (if appropriate at a lower speed). When the squeegee device inside the stencils is then also rendered ineffective, leaking of dye onto the stationary web 13 is thus prevented (see US-A-3 313 232).

The pulley 41 is attached to the entry shaft 43 of a stepped variable gear drive 44, which will be described further below (see FIG. 13). The pulley 42 is attached to the entry shaft 45 of a drive box 46 for the supporting belt 23; see also the left of FIG. 2. The drive box 46 is located on the downstream side of the printing trajectory formed by the stencils 22 indicated by the numbers 1–9 in FIG. 2. In this location, the supporting belt 23 is slung around a drive roller 47, which can be seen in FIG. 2. In this location, the supporting belt 23 is slung around a drive roller 47, which can be seen in FIG. 8, one end not shown of its shaft 50 being self-adjustably mounted in bearings in the main frame 21 and the other end of which is carried by the drive box 46. As can be seen most clearly in FIG. 9, the drive box 46 is supported in the frame 21, so that it can tilt about a line A—A, transversely on the roller 47 in the main frame 21. For this purpose the box 46 is fixed on one side only by means of two bolts 48 using a cylindrical bearing 49. As the shaft 50 of the drive roller 47 is rigidly coupled with the exit shaft 51 of the drive box 465, a certain self-adjustability of the bearing mounting of the drive roller 47 is maintained.

Figure 8:
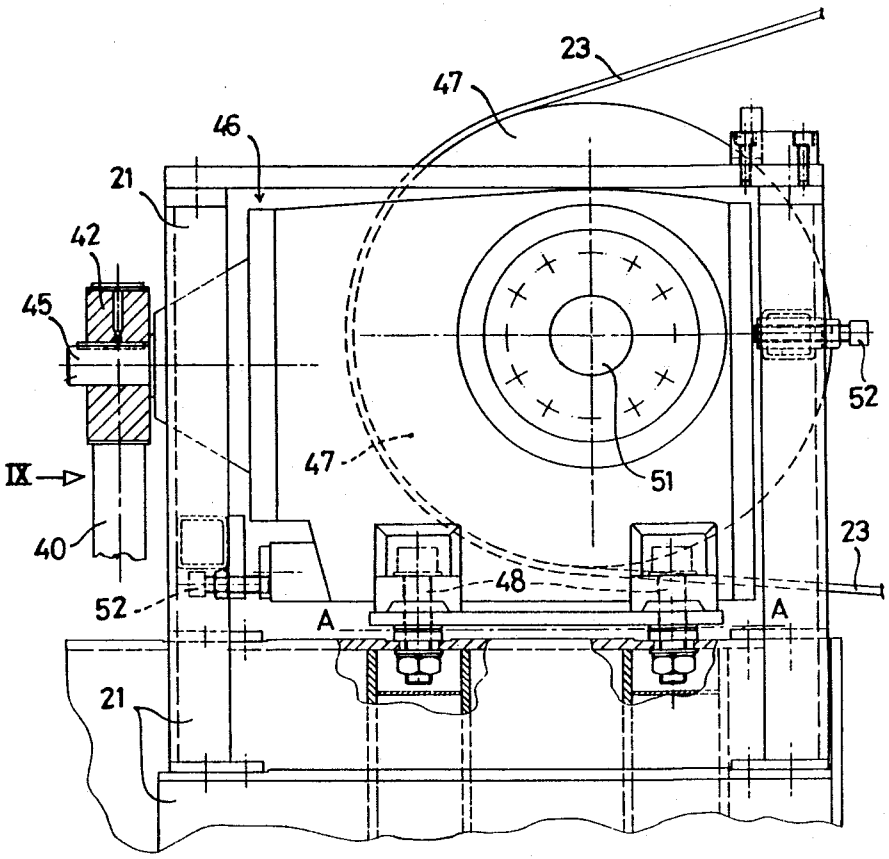
FIG. 8 is a front view of the pivotably supported drive box (partially visible in FIG. 5) for the support belt.
Figure 9:
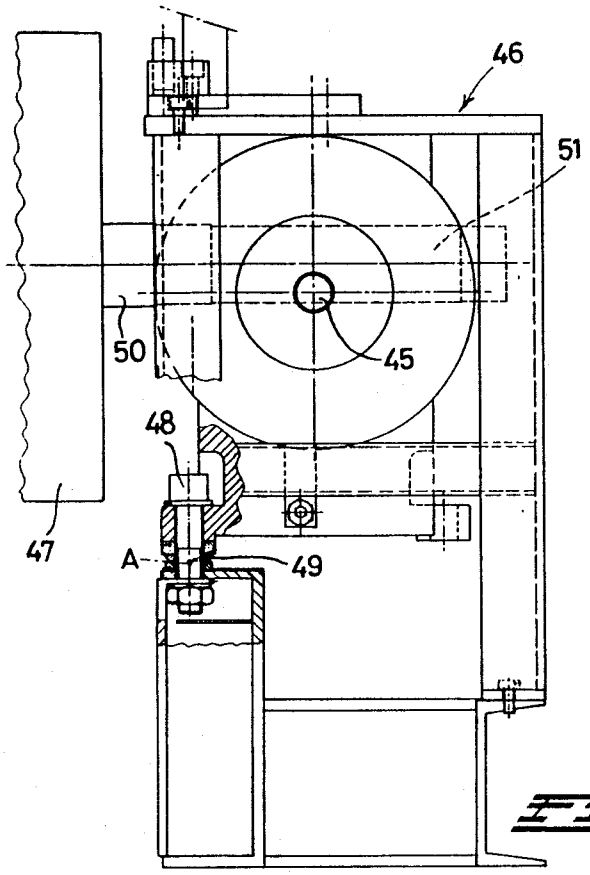
FIG. 9 is a side view in accordance with the arrow IX in FIG. 8.

Accurate alignment of the roller 47 is possible with the aid of two adjusting bolts 52; see FIG. 8.

Figure 10:
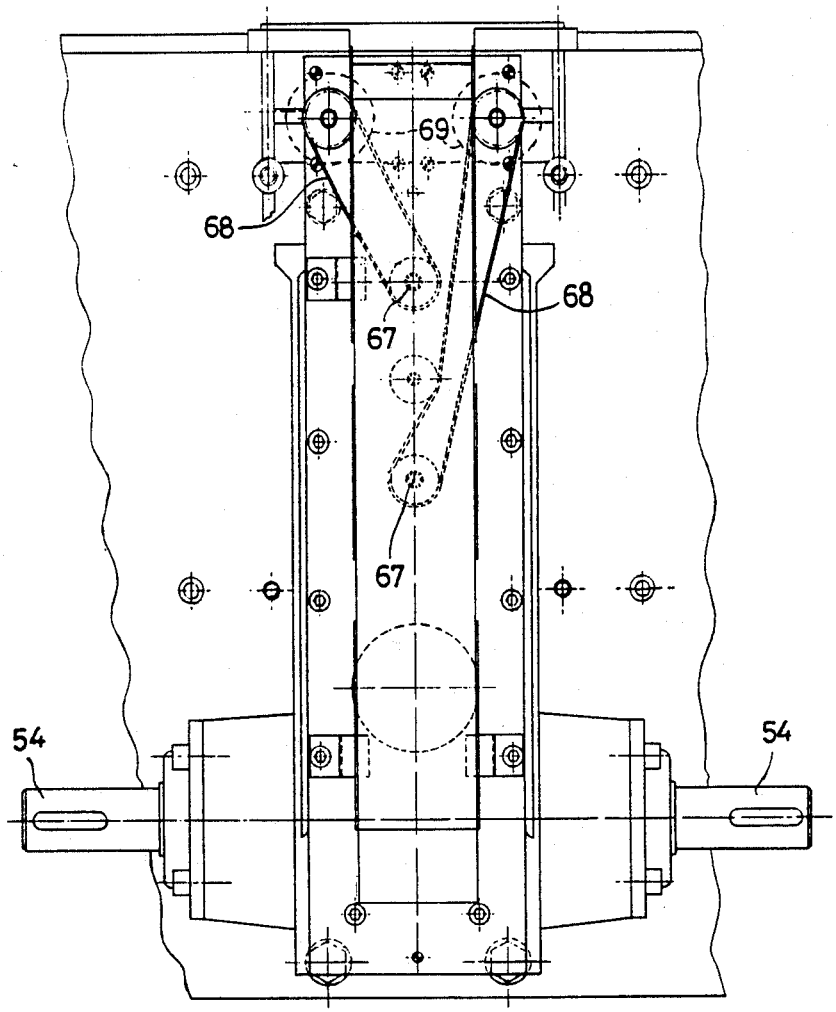
FIG. 10 is a front view of an element from the continuous main drive shaft for the stencils with a casing in which a series of toothed wheels is fitted.
Figure 11:
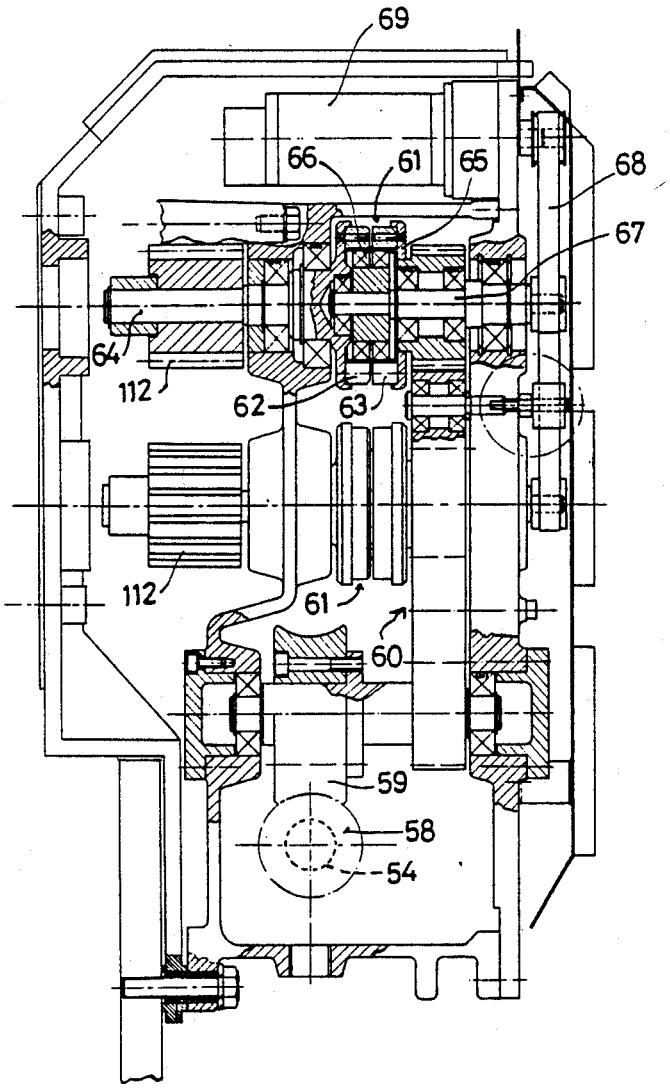
FIG. 11 is a side view in accordance with the arrow XI in FIG. 10, one side of the box having been removed to render the inside visible.
Figures 14, 15, 16, 17, 18:
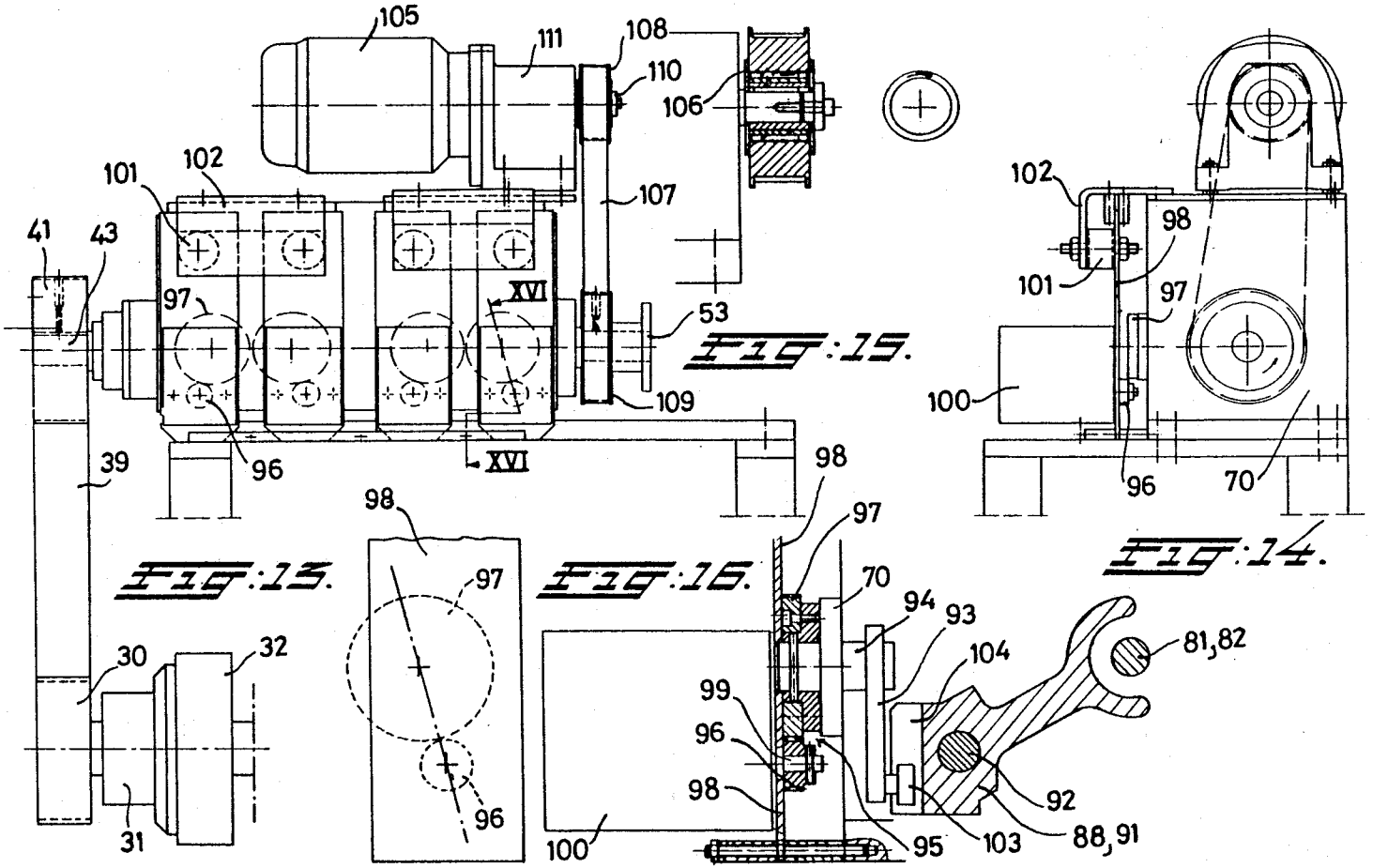
Figure 18:
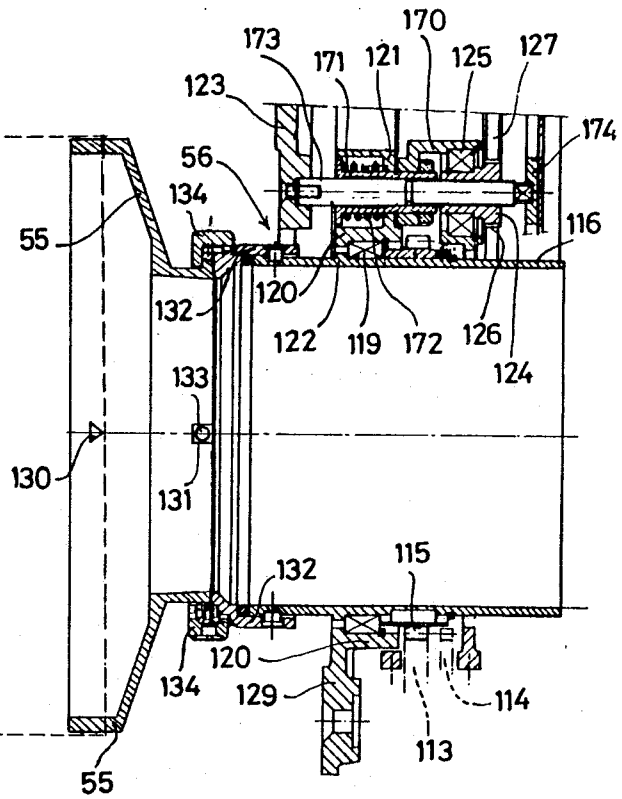
FIG. 18 shows on an enlarged scale a cross-section along the line XVIII—XVIII in FIG. 17.
Figure 17:
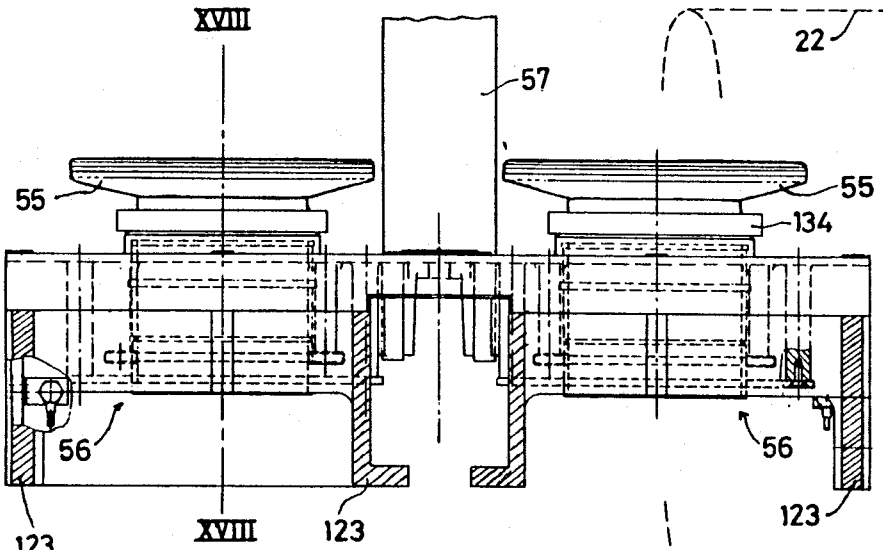
FIG. 17 is a top view of a transverse beam at the drive side.

As can be best seen in FIG. 2, the exit shaft 53 of the stepped variable gear drive 44 is connected to a common main drive shaft 54, located in the longitudinal direction of the machine 11, for the stencils 22. The outer ends of each stencil are provided, in a known manner, with an end ring 55, which is rotatably supported in an assembly head 56. The assembly head is detachably located in a beam 57, which is located transversely above the supporting belt 23. This arrangement is described in detail below and also in the related patent application 87.0...(file 87.5079). The continuous main drive shaft 54 for the stencils 22 is provided at the site of each transverse beam 57 with a worm 58 (see FIGS. 10 and 11) which meshes with a worm wheel 59. This worm wheel 59 is coupled, via a series of toothed wheels 60, shown schematically, with a planetary driving mechanism 61, which, in turn, is connected to a stencil 22. As in the lastmentioned related patent application number 87.0 . . . , and as can also be seen in FIGS. 2 and 17, there is in each case one stencil 22 supported at either side of a transverse beam 57, so that only four transverse beams are required for the eight stencils shown. In connection with this, the series of toothed wheels 60 lead, from the worm wheel 59, to, in each case, two planetary driving mechanisms 61, one driving mechanism of which is connected to the stencil 22 fitted upstream of the transverse beam 57 and the other driving mechanism leads to the stencil 22 supported downstream on the same transverse beam 57. It should be pointed out that on the left of FIG. 11 a schematic cross-section can be seen of the inside of the screen printing machine 11 at the drive side, i.e. the side which is also shown in FIGS. 17 and 18.

The planetary driving mechanism 61 for each stencil 22 is made up of two coaxial and virtually identical sun wheels 62 and 63, each provided with internal toothing, which differ from one another only in one or two teeth. One sun wheel 63 is coupled to the series of toothed wheels 60 (the driven side) and the other sun wheel 62 is connected to the exit shaft 64. The two sun wheels internally mesh with the outer toothing of an elastically deformable annular planet wheel 65, the inside of which is pressed by two sets of diametrically positioned rollers 66 to engage with the internal toothing of the sun wheels 62 and 63. These rollers 66 are supported and driven via an extra entry shaft 67. The planetary driving mechanism 61 just described is part of the state of the art and is known in the industry under the name "HARMONIC DRIVE" (vide NL Pat. No. 140.946).

The extra entry shaft 67 of each planetary driving mechanism 61 is connected via a toothed belt 68 (see FIG. 10) to its own adjusting motor 69. Therefore, there are two adjusting motors 69 per transverse beam 57. With each of these motors it is possible to turn the stencil cylinder connected thereto to the right or to the left in order thus to effect the bringing into register of all of the individual stencils with the numbers 1–8. Each adjusting motor 69 can be driven at a high speed of revolution for the coarse adjustment of the particular stencil 22, while a fine adjustment is effected at a low speed of revolution of the adjusting motor. It is possible to use a pulse counter to achieve the correct position of the stencil very precisely and, also, to reset to this position with very little loss of time after changing the stencil.

The stepped variable gear drive 44 for the stencils 22 consists of eight pairs of toothed wheels 71–78 which engage in one another and are held in a casing 70. One of each pair of toothed wheels is firmly attached to an auxiliary shaft 79. The other toothed wheel belonging to the said pairs of toothed wheels is fitted on a central shaft consisting of three sections 80–82 positioned in line. The toothed wheel belonging to the first pair 71 is firmly attached to section 80 of the central shaft. The toothed wheel belonging to the second pair 72 of toothed wheels can be slid axially along the central section 81, which is provided with key ways, of the central shaft, and is designed with claw couplings 83 and 84 for meshing with, respectively, the first pair 71 of toothed wheels and the third pair 73 of toothed wheels. The other toothed wheels fitted on the central shaft are freely rotatably. In addition, three slidable claw couplings 85–87 are fitted on sections 81 and 82 of the central shaft for engaging or disengaging a coupling between the relative toothed wheels and the said sections 81 an d82 of the central shaft. Section 80 of the central shaft forms a whole with the entry shaft 43, while sections 81 and 82 of the central shaft, which are connected to one another, are coupled to the exit shaft 53. The four claw couplings are moved axially with the aid of sliders 88–91 which can be moved along a sliding rod 92. The slider 88 can assume four different positions, while the sliders 89 and 91 can be slid from a central position in which they are ineffective to a left or a right effective position. The slider 90 is movable only from a left ineffective position to a right effective position.

Figure 12:
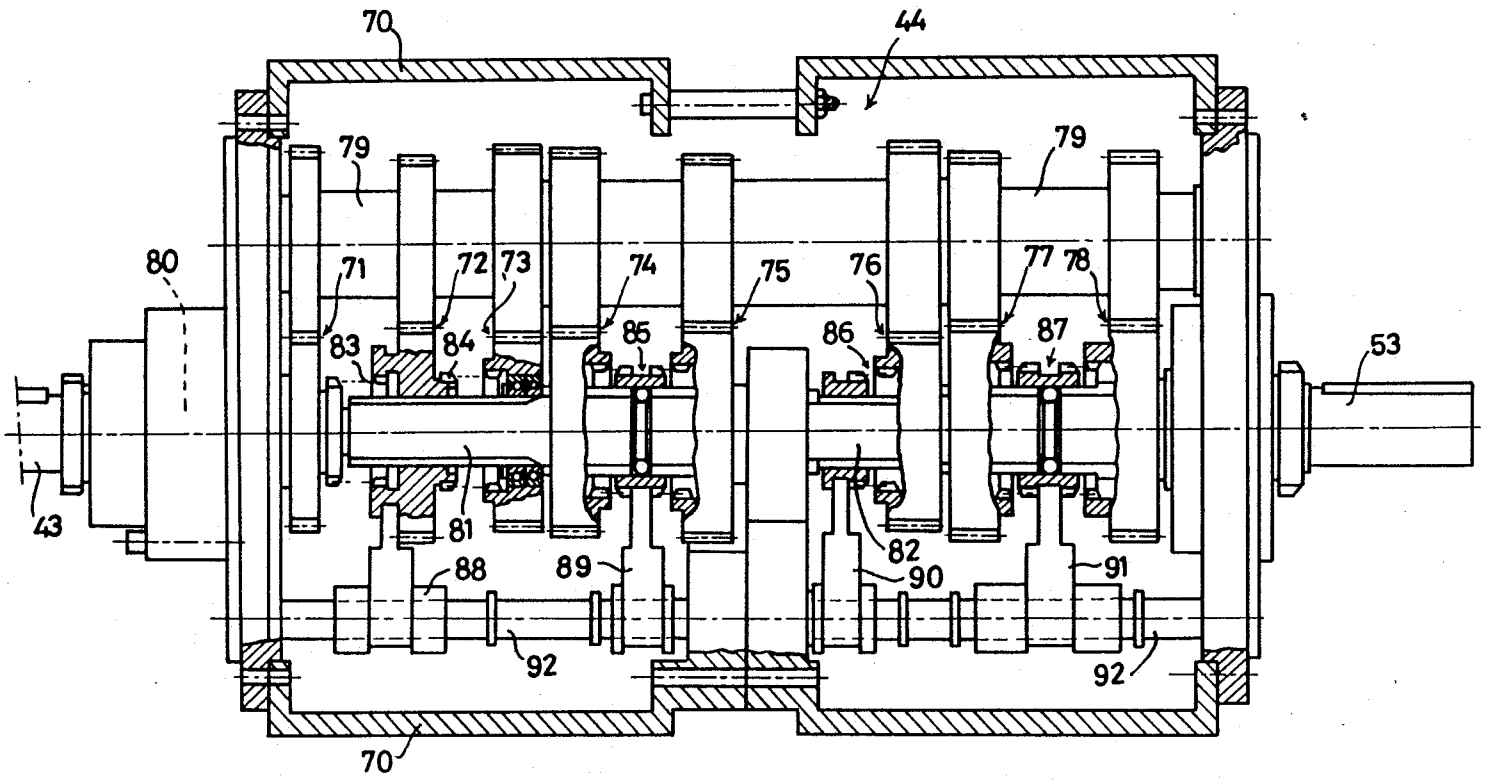
FIG. 12 is a longitudinal cross-section of the stepped variable gear drive belonging to the drive mechanism for the stencils.

In the situation shown in FIG. 12, only the pairs 71 and 72 of toothed wheels are effective and a certain transmission ratio between the entry shaft 43 and the exit shaft 53 is brought about. In the far left position of the slider 88, the shafts 43 and 53 are directly coupled and the pair 72 of toothed wheels is free. In the adjacent position of the slider 88, the pair 72 of toothed wheels is likewise free and one of the other sliders 88–91 can effect a connection between the entry shaft 43 and the exit shaft 53 with a transmission ratio determined by one of the engaged pairs 74–78 of toothed wheels. In the far right position of the slider 88, the transmission ratio between the entry shaft 43 and the exit shaft 53 is determined by the pair 73 of toothed wheels. Therefore, eight different transmission ratios are possible with this stepped variable gear drive. The choice of the transmission ratio is related to the diameter of these stencils 22 which is employed, as the circumferential speed of these stencils must be equal to the speed at which the supporting belt 23 moves along.

The claw couplings 83–87 which are slidable along the spline shaft 81 can be moved, with their associated sliders 88–91, by means of a device shown in FIGS. 13–16. This consists of a shift arm 93 which is attached to a clutch shaft 94, rotatably fitted in the casing 70. Turning of this clutch shaft 94 is effected with the aid of toothing 95. This consists of a pinion 96 and a toothed sector 97 which engages in this and is firmly attached to the clutch shaft 94. An assembly lever 98 is pivotably mounted on this same shaft 94, while the pinion 96 is attached to a second shaft 99, which is likewise rotatable in the said lever 98. This shaft 99 is the exit shaft from an adjusting motor 100 suspended on the assembly lever 98. An elongated upper section of this assembly lever 98 is movably connected via an elastically springing link 101, to an angular plate 102 which is attached to the frame or casing 70. Each shift arm 93 is provided at its free outer end with a roller 103 which engages in a groove 104 of the particular slider 88–91.

On the casing 70 of the stepped variable gear drive 44 there is, in addition, an auxiliary motor 105 which is connected via a freewheel clutch 106 (see FIG. 15) to the exit shaft 53 of the gear drive 44. This connection likewise consists of a toothed belt 107 which is engaged around the toothed pulleys 108 and 109 mounted on the shaft 110 of the auxiliary motor 105 and on the exit shaft 53 respectively. The auxiliary motor 105 is designed with a pulsating excitation 111 which is effective during shifting to another velocity ratio within the stepped variable gear drive 44. As will also be explained below, the pulsating drive of the auxiliary motor 105 promotes the synchronization of the slidable claw couplings 83–87 of the variable gear drive.

When it is necessary, after choosing a certain diameter of the stencils 22, to shift the stepped variable gear drive 44 to a specific transmission ratio, this means that one or more of the claw couplings 83, 84 and 85–87 have to be moved with the aid of the sliders 88–91. As can be seen in FIG. 16, this movement can be effected with the aid of the adjusting motor 100, of which there are four, i.e. one motor per slider or claw coupling. Turning of each shift arm 93 is effected by means of a suitable operation of the relevant adjusting motor 100. This type of operation is eminently suitable for execution with the aid of a simple program stored in a computer. Each of the eight different transmission ratios from the variable gear drive 44 demands a specific position of each of the claw couplings and therefore of each adjusting motor 100. When switching from one position to the other, problems can arise by the engagement of the two parts of a claw coupling to be engaged and to avoid these problem element 96–101 and 105–111 are provided, as explained below.

When, for example, the claw coupling 83 or 84 associated with the pair 72 of toothed wheels must engage with either the toothing on the outer end of section 80 of the central shaft or with the claws associated with the pair 73 of toothed wheels, the relevant slider 88 is moved to the left or to the right (in FIG. 12) by the operation of the relevant adjusting motor 100. This movement can take place without hindrance and continues until the two toothed wheels of the pair 72 have separated from one another. A further movement of the claw coupling 83 or 84 can take place only when the counter-claws on section 80 of the central shaft or, respectively, associated with the pair 72 of toothed wheels are in the correct position. However, the relevant adjusting motor 100 causes a rotation of the clutch shaft 94 and thus turning of the shift arm 93 in accordance with the intended final position. The slider 88 is usually immovable for this final stage because the relevant claws are stopped by one another and do not engage. As a consequence of the stopping of the slider 88, the clutch shaft 94 with the tooted sector 97 is also locked. The pinion 96 of the adjusting motor 100 now has to give way and rolls away along the stationary tooth sector 97. This rolling away is possible because the assembly lever 98 is rotatable around the fixed clutch shaft 94 and can move aside against the elastic force of the springing link 101. In this way the adjusting motor 100 can achieve its intended final position, although the claw coupling has still not engaged.

In general, there will be a difference in rotational speed between the two sets of claws which are to be engaged. At a given point in time this difference in speed leads to the claws, which after all are pressed against one another by a force generated by the turning of the assembly lever 98 and the deformation of the springing link 101, being pushed into one another. However, it is possible that it will be a long time before this engagement point is reached, particularly if the sections 81, 82 of the central shaft are stationary with the exit shaft 53. For this purpose the auxiliary motor 105 is provided, which, via the freewheel clutch 106 and the toothed belt 107, turns the exit shaft 53. If this shaft 53 itself already turns for some other reason, the freewheel clutch 106 ensures that this rotation is not transmitted to the auxiliary motor 105. The available pulsating excitation 111 ensures that the exit shaft 53, and therefore the sections 81, 82 of the central shaft, are always given a little push to promote the engagement of the claws. This engagement is achieved under the influence of the force which is permanently exerted by the deformed link 101. As soon as the relevant claw coupling 83 or 84 engages, the shift arm 93 turns with the clutch shaft 94, whereby the toothed sector 97 also turns and carries with it the pinion 96 with the assembly lever 98. The deformation of the elastic link 101 is thus cancelled and the shifting of the variable gear drive 44 is complete.

Figure 19:
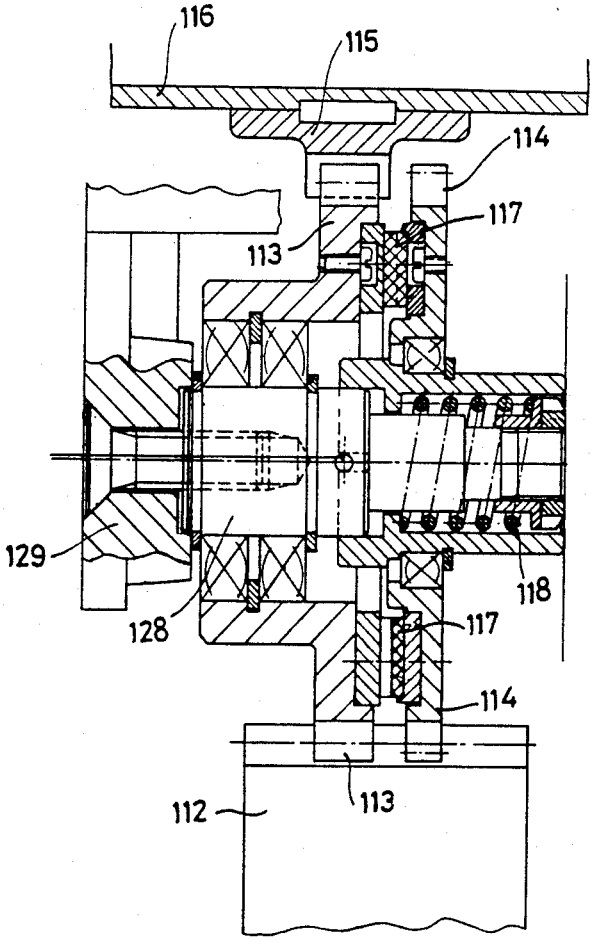
FIG. 19 shows, in longitudinal cross-section and on an enlarged scale, a detail from the drive from the end of a stencil.
Figure 20:
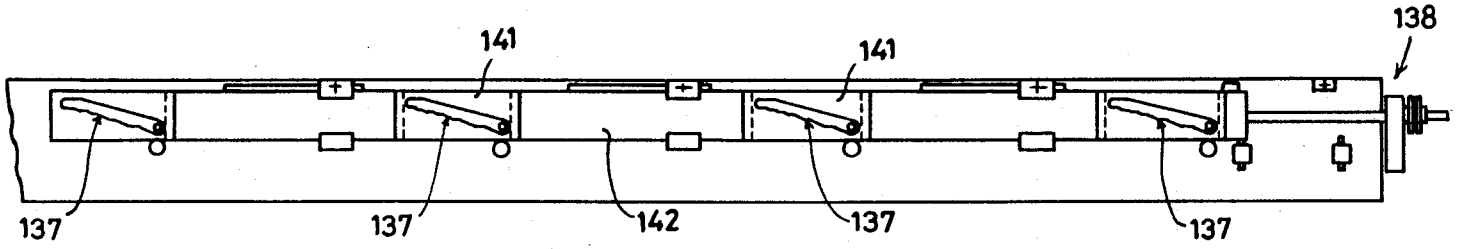
FIG. 20 shows the most important part of the means for adjusting the belt height.
Figure 21:
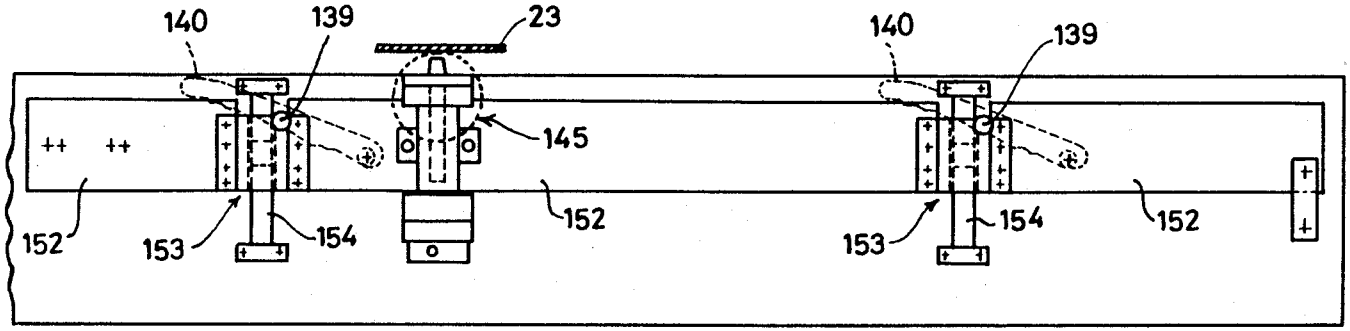
FIG. 21 shows on an enlarged scale the central section of the lifting device located just in front of the adjustment means in FIG. 20.

FIGS. 17–19 relate to a detail from the drive of each of the stencils 1–8 from FIG. 2. The drive of each stencil is effected via the exit shaft 64 of the planetary driving mechanism 61; see FIG. 11. A toothed wheel 112, with which two other coaxial toothed wheels 113 and 114 engage, is attached to this exit shaft 64. These toothed wheels have only one tooth difference between them, the broadest toothed wheel 113 transmitting the drive torque from the toothed wheel 112 to a crown gear 115. This gear is fixed on a sleeve 116 which forms part of the assembly head 56. The narrower toothed wheel 114 has the same external diameter as the toothed wheel 113, but has one tooth more. As a result a small difference in speed will arise between the two toothed wheels 113 and 114. These toothed wheels are provided, on the sides which face one another, with an annular layer of friction material 117. The toothed wheel 114 is pressed by means of a spring 118 in the direction of the toothed wheel 113 so that the two friction rings 117 are permanently in contact with one another. As a consequence of the resulting permanent braking force, the play which inevitably arises between the teeth of the subsequent series of toothed wheels will always manifest itself in a manner such that the rapport relationship between the subsequent stencils cannot be subject to any small modifications. The toothed wheels 113 and 114 of this friction brake are bearing-mounted on a shaft stub 128 which is attached to one lug 129 of a sleeve 120, which will be mentioned below.

Two assembly heads 56 (see FIG. 17) and two toothed wheels 112 (FIG. 11) are located in each transverse beam 57. Therefore, there are also two friction brakes 113–115 in each transverse beam 57. The suspension of the sleeve 116 in the assembly head 56 is effected via a roller bearing 119 contained in the sleeve 120 provided with four radially projecting mountings 121. Only one of these is shown in FIG. 18. An axially directed pin 122 runs through each mounting 121, the end of the pin facing towards the stencil 22 being attached in a drive casing 123 which is firmly connected to the main frame 21. Close to the other end, the pin 122 is provided with a screw thread on which there is a nut 124. This nut rests, via a bearing 125, against the mount 121. When the nut 124 is turned on the fixed pin 122, the nut will move along the pin. Via the bearing 125, this movement will cause an identical movement of the mounting 121 and of the sleeve 116 (and of the stencil 22). The sleeve 120 of each assembly head 56 is provided with four mountings 121, so that there are also four adjusting nuts 124. Each nut has external toothing 126 which engages with a common toothed belt 127. By operation of this toothed belt, the relevant stencil 22 can be moved axially, i.e. in the widthwise direction relative to the supporting belt 23. A movement of this type is possible because of the presence, on the opposite stencil end (the pump side), of a springing tension device, described in a further portion of this specification.

When the installation according to FIG. 1 is functioning, a web of an inexpensive quality (a so-called leader) is first fed through the printing machine 11. The required length of the leader with which the printing machine can be set entirely ready for use is known experimentally. The leader is stored in the temporary buffer or collecting tube 14 and the material actually to be printed (the web 13) is sewn onto the trailing end of the leader. The feed of the web 13 from the roll 12 is determined such that, at the time that the leader/web seam passes through the printing machine 11, the buffer 14 is empty and the web 13, to be printed, is at the correct tension (by means of regulator 17). A new leader is sewn onto the trailing end of the web 13, for which purpose the final section of the web 13 is fed at accelerated speed into the buffer 14. After this second web/leader seam has passed through the printing machine 11, the installation can be stopped and the actual printing (the run) is complete with as little loss as possible of valuable web material.

The so-called PICO point, i.e. a marker 130 close to the edge of each cylinder stencil 22 (see FIG. 18), has been discussed above. The end ring 55 at the drive side of each stencil has a notch 131 located in the same radial surface as the PICO point. The assembly ring 132 of each sleeve 116 is provided with a pin 133 which fits into the notch 131, after which a bayonet ring 134 effects the fixing of the stencil. The PICO point has a fixed position relative to the design on the stencil 22. In addition to the pin 133, the assembly ring 132 is also provided with a magnetic block (not shown) which can interact with a sensor (not shown) fitted in the fixed drive casing 123 belonging to the assembly head 56. In the automatic regulating system already described for this purpose, for bringing into register (setting) the stencils 22 (see pages 3 and 4) it suffices to store the angular position of the stencil with sequence number 1 in the memory of a computer and from there to calculate and likewise determine the theoretically correct angular rotation for the subsequent stencils 2–8. The sleeves 116 with the assembly ring 132 can now be brought into the correct position via the computer by driving the adjusting motors 69 at high speed. All stencils can then be positioned and are in the correct mutual rapport position. During the test run with the printing machines (using a leader) a fine after-adjustment of the stencils can be obtained with a low speed of revolution of the motors 69. These data are also sorted in the computer memory, so that later, when the same design is printed again, the assembly rings 132 and thus also the cylinder stencils can be brought into precisely the correct angular position with respect to one another in a single operation.

The squeegee construction employed is not specified in this specification. In principle, a trailing blade squeegee can be used, but a so-called double bladed slot squeegee is also possible, see U.S. Pat. No. 4,753,163, or a (magnetic) roller squeegee, see the related Patent Application NL No. 87.02420 (file 886051).

As shown in FIGS. 20–23 the level of the path section A of the belt 13 is determined with the aid of adjustment means which are depicted most clearly in FIGS. 20–23. These means provide adjustment of the position of guiding devices 136 (visible in FIG. 25).. These adjustment means consist of a series of cam faces 137 which are coupled together and which are provided with a common adjustment device 138. Each cam face 137 cooperates with a follower 139 device 139 which is directly coupled to a belt guiding device 136. Each cam face 137 consists of the lowermost boundary of a groove 140 in a strip 141. This limitation, i.e. this cam face 137, has a stepwise construction as may be seen in FIGS. 21 and 23. The strips 141 are coupled together by similar strips 142 (without groove 140) and said coupled strips are mounted so as to be movable in the main frame 21 parallel to the horizontal path section A of the supporting belt 23. This ability to move is made possible by the use of slide guides 143 located opposite each other, whilst the reaction forces operating on the strips 141 and derived from the follower 139 are taken up by a supporting roller 144 fitted vertically under each follow-on device.

A pneumatic lifting device 145 is present between each follower 139 cooperating with a cam face 137 and the associated belt guiding device 136 and is constructed with two end positions for raising the belt guiding device 136 to its operating position and lowering said device to a position in which the supporting belt 23 runs free of the stencil 22. The lifting device 145 is constituted by a housing 146 which has a piston 147 and a piston rod 148 functioning as a push rod. Said rod 148 engages a stub axle 149 of the guiding device 136 embodied as a roller. The uppermost operating position of the guiding device 136 is determined by an accurately adjustable screw pin 150 fitted in the upper cover 151 of the housing 146. Raising and lowering of the supporting belt 23 therefore takes place simply by inflow or outflow of pressure medium in the space under the piston 147.

Figure 22:
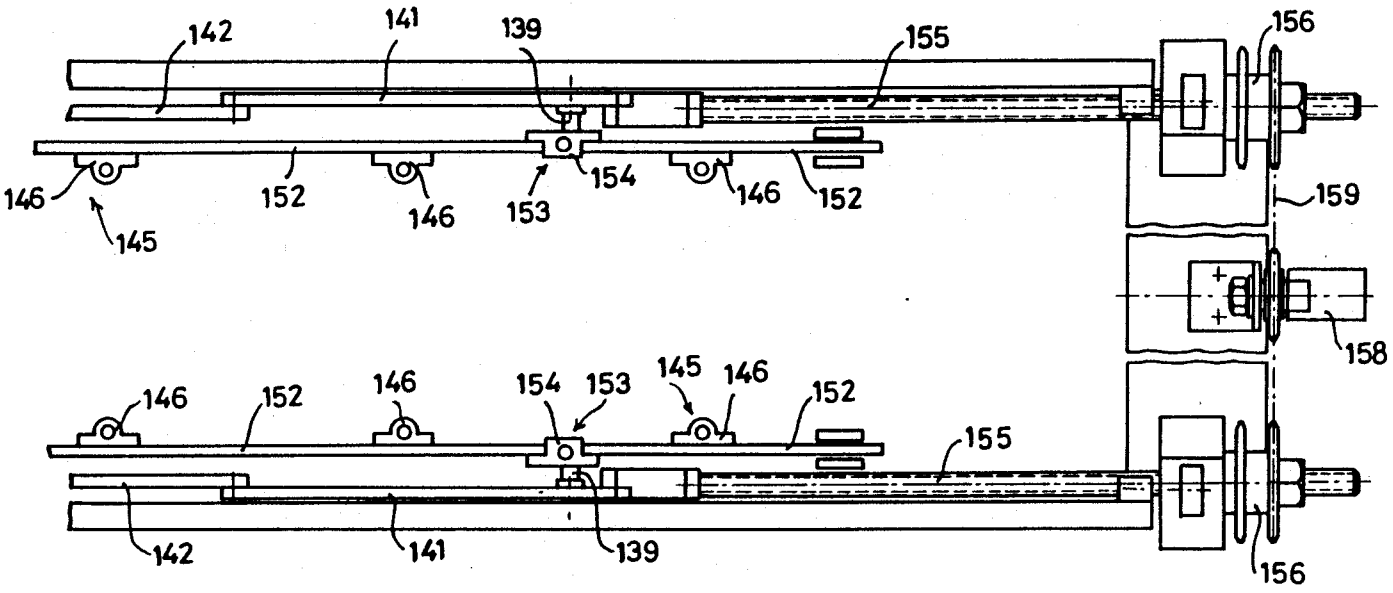
FIG. 22 is a plan view of the section located on the far right of FIG. 2.
Figure 23:
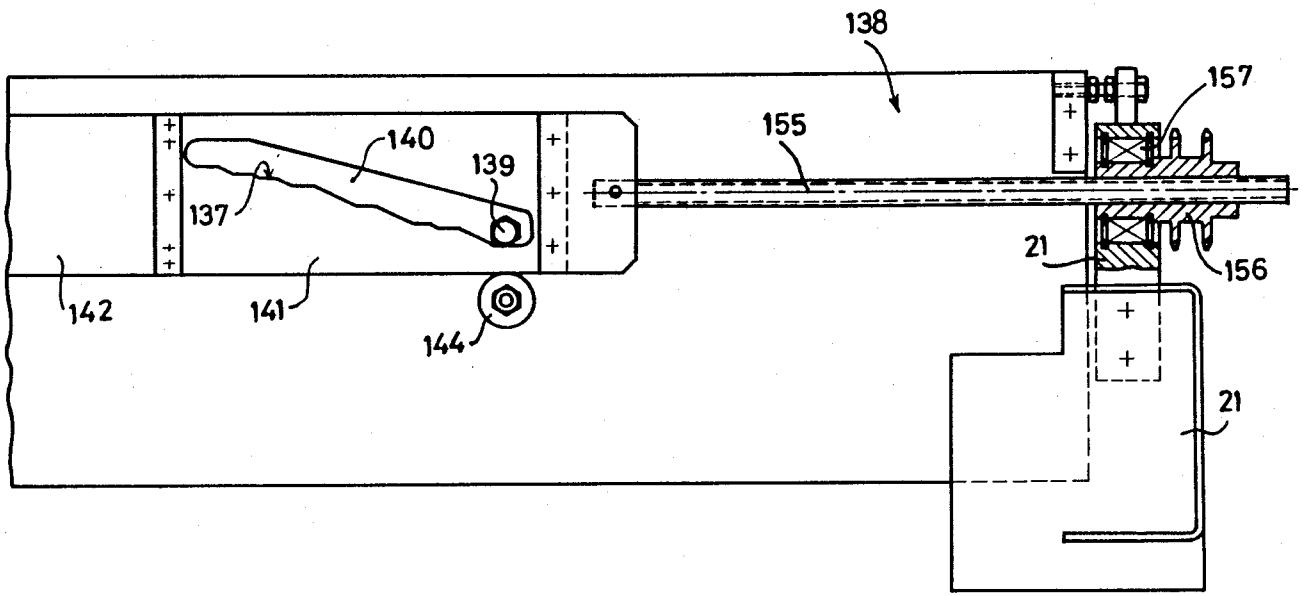
FIG. 23 shows on an enlarged scale a detail from the right-hand side of FIG. 3.

The height adjustment of each housing 146 is determined by a strip 152 coupled thereto (see FIG. 22). Three strips 152 are connected together by two coupling blocks 153 which can slide along short and firmly fixed vertical rods 154. Four housings 146 of the same number of pneumatic lifting devices 145 are fitted on these three strips 152 (in this embodiment). A follower 139 is attached to each coupling block 153 such that two cam faces 137 always determine the position of four of said lifting devices 145, i.e. of four guiding devices 136.

The cam face 137 has a stepwise construction and consists of eight horizontal levels which are connected by means of intermediate sections which slope downwards. Said levels are related to the diameter of the cylinder stencils 22 used. In the position according to FIG. 23, the follower 139 cooperates with the lowest cam level which means that the stencils 22 have the largest permissible diameter. By moving the coupled strips 141, 142 with the aid of the adjustment device 138 to be further described below, each follower 139 is raised in a stepwise manner to a subsequent level associated with the use of cylinder stencils with decreasing diameters.

The adjustment device 138 for the cam faces 137 is constituted by a screw thread rod 155 lying in line with the coupled strips 141, 142 and which cooperates with a nut device 156 which is rotatably mounted so that it cannot be moved axially in the frame 21. For this purpose a roller bearing 157 (see FIG. 23) is present which can take up both radial forces and some axial load. As may be seen in FIG. 22, a set of coupled strips 141, 142 with cam faces 137 is mounted on either side of the machine and a single drive motor 158 is present which cooperates via a toothed belt or chain 159, with the nut device 156 of the thread rod 155 associated with each of the two sets of coupled strips. It is also possible to achieve drive via toothed wheels. It is essential that the two nut devices 156 undergo precisely the same rotation.

As may be seen in FIG. 26, a strip 160 is present which is connected to the coupled strips 141, 142. Said strip is provided with a number of permanently magnetic pulse emitters 161. With the aid of one or more sensors 162 the same number of positions of the coupled cam faces 137 can be achieved by relevant control of the drive motor 158 as there are stepped cam positions available in the grooves 140. The user of the printing machine has only to key in a predetermined code whereupon the motor 158 operates until the sensors 162 detect that the cam faces 137 have reached the required position.

FIG. 27 shows a device for tensioning and slackening the supporting belt 23. The return roller 47', located near the position at which the web 13 is brought into contact with the belt 23, is supported in a movable manner in the main frame 21 of the machine. Each end of said movable return roller 47' is connected with a screw rod 163 on which a rotatable but axially nonmovable nut device 164 is fitted. A motor drive 165 is located on a lower level, as may be seen in FIG. 2. A device 166 for measuring the tensile stress is present in the screw rod 162. This measuring device can emit a pulse as soon as the desired tension is reached in the supporting belt 23. Said pulse then switches the motor drive 165 off.

When a new design has to be printed in the printing machine according to the invention and the stencils 22 have to be changed for this purpose, the operations summarized below are performed, after having first lowered the supporting belt 23 by the operation of the pneumatic lifting devices 145, the stencils 22 previously used are removed and the continuous belt 23 is slackened by operation of the motor drive 165:

in the first place the cam faces 137 are brought to a position which corresponds with the diameter of the new stencils to be fitted, with the aid of the adjusting device 138, via data received in a computer; the movement of the cam faces 137 and the stopping of the adjustment device 138 is achieved by the cooperation of the strip 160 with the sensors 162;

the drive means 135 are also brought automatically to the correct transmission ratio for harmonizing the linear speed of the supporting belt 23 in the handling path A with the circumferential speed of the new stencils, all of which is as described in the preceding part of this specification; in this connection all of the operations may also take place automatically by virtue of the data which have been stored in the memory of the said computer;

the new stencils may then be positioned, the inner sleeve of the assembly head on the driven side of the machine being placed firstly in the correct angular position, as is also described in the just mentioned preceding part;

the guiding devices 136 are then brought into the operating position depicted in FIG. 24 by means of operating the pneumatic lifting device 145;

finally, the motor drive 165 is activated and the supporting belt 23 is tensioned until the measuring device 166 detects that the correct tension has been achieved and emits a pulse for stopping the motor drive.

The structural embodiment described above makes it possible to achieve virtually all of the operations automatically so that the least number of time losses possible occurs, the operating personnel can be limited to a minimum and a very accurate height adjustment of the supporting belt 23 in the path section A can be achieved without human error.

FIGS. 17, 18, 28 and 29 show the transverse beam 57 and the assembly heads 56 at the drive side of the screen printing machine. The assembly heads are mounted in an extension 123 of the outer end of each transverse beam 57, which is firmly attached to the machine frame 21 and extends transversely over the web to be printed. As explained in a preceding portion of this specification, the nuts 124 are provided with an external toothing 126, which cooperate with a toothed belt 127. This belt is driven by a motor 167. To save space, the axis of the motor 167 is located in a plane which runs parallel to that of the belt 127. The motor is connected to a right-angled transmission 168 which has, at its exit shaft, a pinion 169 engaging the belt 127.

As shown in FIG. 18 each of the four mountings 121 is associated to a component 170. The nuts 124 are mounted in the concerning component 170. The two elements 121 and 170 are connected to one another by means of a bush 171, which is provided with a shoulder and is attached to the component 170 by means of a nut. The mounting 121 is pressed against the component 170 by a compression spring 172, one end of which presses directly against the mounting 121 and the other end of which rests against the shoulder of the bush 171.

The bush 171 and the nut 124 are mounted on a screwed spindle 173, one end of which is secured in the extension 123. By these means the adjustment of the axial position of the stencil is separate from the attachment of the stencil 22 to the assembly head 56. Consequently possible minor inaccuracies in the attachment of the end ring 55 to its stencil 22 can be absorbed without disruptive varying stresses arising in the assembly head; indeed these are damped by the springs 172. The same is also true for the reaction forces which are generated in the stencils 22 and the end rings 55 as a consequence of the pressure exerted during operation of the squeegee on the inner face of the stencil.

The spindles 173 are held at the end opposite to the extension 123 by a support plate 174 with four lugs, which are attached by means of screws 175 to ribs 175 formed on the extension 123 (vide FIG. 29).

The design of the opposite assembly heads 177 on the pump side will now be described with the aid of FIGS. 30 and 31. Such an assembly head 177 is located in an adjustable extension 178 analogous to the fixed extension 123 at the drive side. This head 177 comprises a non-rotatable section 179 and a rotatable sleeve 180 equivalent to sleeve 116 shown in FIG. 18. The sleeve 180 is mounted in the other section 179 by means of a bearing 181. It is observed that the sleeve 180 is not provided with a separate drive since the rotation for each stencil 22 is generated in the assembly heads 56 from the — opposite — drive side (vide FIGS. 18, 19). The section 179 of the assembly head 177 is connected to an intermediate component 182 by means of three pneumatic cylinders 183. The component 182 is self-adjustingly attached to the extension 178 via a screw fitted to the free end of the piston rod 184 of the cylinder 183. The non-rotatable section 179 of the assembly head 178 is slidably mounted at 185 in the intermediate component 182. The cylinders 183 are attached to the section 179 of the assembly head 178. The cylinders 178 are connected at 186 by conduits 187 to one another and to a source (not shown) of compressed air, (vide arrow 188).

By means of the three piston-cylinder devices 183, 184 each stencil 22 can directly and concentrically be axially tensioned relative to the intermediate component 182 and thus to its extension 178. With this arrangement the independent action of each piston-cylinder device will compensate for any bending of the assembly head 177. As a result, axial adjustment of one end of the stencil 22 is possible by means of the nuts 124 and the spindles 173 (see FIG. 18) on the drive side. The other end of the stencil can follow elastically on the pump side. Once the sleeve 180 is attached to the stencil 22, the piston-cylinder devices 183, 184 are then operated such that they move the assembly head 177 in a direction away from the drive side (to the right in FIG. 30), so that the stencil is kept under tension and cannot twist as a result of the one-sided drive.

The intermediate component 182 can be shifted in horizontal direction along the extension 178 parallel to the direction of travel P shown in FIG. 1. The device 189 serving this purpose is shown in FIGS. 31 and 34.

A tubular hub 190 provided with an internal screw thread is mounted within the intermediate component 182 by means of a bearing 191 which on its turn is secured in the intermediate component 182 by means of a retaining ring 192. The internal screw thread of the hub 190 cooperates with a screwed spindle 193 which runs out into a head 194. This head is attached by means of a screw 195 to the extension 178 (not shown in FIG. 34). A conical toothed wheel 196 is formed on one end of the hub 190. This wheel 196 engages in a conical toothed wheel 197 which is fixed to the exit shaft 198 of a motor 199. This motor is mounted by means of bolts 200 to the component 182; these bolts at the same time firmly hold a bearing 201 in the component 182. The conical toothed wheels 196 and 197 form a right-angled transmission via which the motor 199 moves the hub 190 along the spindle 193. Consequently the component 182 is shifted relative to the extension 178.

This arrangement is advantageous because the space required for the device 189 can thus be kept to a minimum.

A toothed wheel 202 is secured by means of a nut 203 to the outer end of the hub 190. This wheel 202 engages in a toothed wheel 204 which is firmly attached to the entry shaft 205 of a potentiometer 206 which serves as the registration device for recording the angular shift the toothed wheel 202 and thus the displacement of the hub 190 and of the component 182. The potentiometer 206 is connected to a known electronic regulating device (not shown) by means of which the motor 199 can be controlled. The displacement of the component 182 gives an equal translatory movement to the concerning assembly head 177. This enables the operator (printer) to bring the stencils 22 exactly in register with each other. As shown in FIGS. 32, 33 the extension 178 on the pump side are attached to the transverse beam 57 by means of a cradle 207 so that they are movable in the longitudinal direction of the beam. The principal component of the cradle is a cradle body 208. As can best be seen in FIG. 33, this body rests on a rail 209 which is attached to the transverse beam 57. The cradle body is provided with flanges 210 which hang over the rail 209 and rest against the side edges of this rail. A bolt 210 extending through a thickened section in the center of the cradle body 208 can be attached to the transverse beam 57.

The cradle body 208 is provided with a recess 211 on its underside and rests only with edges on the rail 209. As a result of this the requisite surface accuracy for both the underside of the cradle body 208 and the rail 209 is less than would be the case if the cradle body 208 were to rest with a complete base surface on the rail 209. Upstanding strips 212 are attached on either side of the cradle body 208. Hook members 213, by means of which the extension 178 can be slidable suspended from the cradle 207 hang over these strips 212.

The cradle body 208 is provided with a cover 214 which is attached by means of a hinge pin 215 to one end of the cradle body 208. The possibilities for moving the assembly heads 177 in longitudinal direction of the stencil and of the beam 57 are as follows. On the drive side (FIG. 18) the assembly heads 56 are positively axially movable by means of the nuts 124. On the pump side (FIG. 30), the cradle 207 with the two extensions 178 can be shifted over the rail 209 and fixed; the extensions itself can each individually be slid along the upstanding strips 212 of the cradle 207. Thus, the assembly heads 178 can be adjusted to the length of the stencils and clearance can be provided for the assembly and dismantling thereof. Finally, the piston-cylinder devices 183–184 hold the stencil 22 under tension in the manner described and passively follow the axial positioning of each stencil from the drive side, so that this positioning can be performed from one side only.

The attachment of the end rings 55 of the stencils 22 to the relevant rotatable, tubular sleeve 180 of the assembly heads 177 shown in FIG. 30 is somewhat different from the structure of FIG. 18. The end ring 55 of the stencil 22 is designed for fixing by means of a quarter-turn to the sleeve 180. Between the end ring 55 and the sleeve 180 there is a coupling ring 216. This ring is detachably secured to the sleeve 180 by means of a bayonet fastening comprising pins 217 which fit in grooves 218 on the outer circumference of the sleeve 180 and can be arrested therein in a known manner. A filling ring 219 prevents the coupling ring 216 from becoming loose from the sleeve 180. A same kind of filling ring is visible in FIG. 18.

What is claimed is:

1. A multicolor, rotary screen printing machine comprising a main frame provided with a number of parallel cylinder stencils; a pair of end rings for each cylinder stencil, each end of each cylinder stencil being fitted in a respective end ring; a continuous supporting belt forming a horizontal operative path section for the material to be printed; at least one beam lying transversely above the supporting belt, each transverse beam being fixed upon the mainframe and being provided at each end with two opposed extensions transverse to the beam, each extension comprising an adjustable mounting means, and an assembly head accommodated by each mounting means, each end ring of a stencil being rotatably supported in an assembly head; and guiding devices for guiding the belt along the horizontal operative path, the machine further comprising a single motor positioned outside the main frame; an intermediate shaft located inside the frame, the intermediate shaft being driven directly by the single motor and being connected to the stencils; and common adjusting means for the supporting belt and guiding devices for determining the level of the operative path section of the supporting belt and for establishing an operative relationship between the material to be printed and the stencils.

2. The screen printing machine of claim 1, wherein the intermediate shaft has a slip-free transmission with a stepped variable gear drive for rotating the stencils and with a drive box for advancing the supporting belt; a common main drive shaft being provided in the longitudinal direction of the machine for driving the stencils; the variable gear drive having an exit shaft connected to the common main drive shaft; and the common drive shaft being coupled via a series of toothed wheels to a separate planetary driving mechanism for each of the stencils.

3. The screen printing machine of claim 2, wherein the planetary driving mechanism for two coaxial each stencil comprises, substantially identical, sun wheels, at least one elastically deformable annular planet wheel and a planet ring; the sun wheels having only one or two teeth difference between them, the two sun wheels being incorporated in the drive of the stencil and meshing with the annular plant wheel; and the planet wheel being connected to an adjusting motor, and adjusting motor being provided with a relatively moving member and with a pulse counter for counting pulses generated by the relatively moving member so as to position the stencil precisely.

4. The screen printing machine of claim 2, wherein the stepped variable gear drive (44) for the stencils comprises a casing (70), a number of pairs of interengaging gear wheels (71–14 78) housed in the casing, a spline shaft (81,82), several claw couplings (84,87) which are slideable axially along the spline shaft, a slider for each claw coupling, a respective shaft arm (93) for each slider pivotally mounted on the casing so as to move its associated slider and claw coupling parallel to the spline shaft, and a toothing (93) for converting the rotation of an adjusting shaft through a turning of the clutch shaft with its shift arm (93) into axial movement of the respective claw coupling so that the shift arm can be turned by the adjusting shaft (99) to set a desired gear ratio with the aid of the toothing (95).

5. The screen printing machine of claim 4, wherein the toothing (95) for each shift arm (93) comprises a pinion (96); a tooth sector (97) engaging the pinion; a clutch shaft (94) located in the casing (70) onto which the shift arm (93) is attached, the toothed sector (97) being attached to the clutch shaft (94); an assembly lever (98) pivotably positioned on the clutch shaft (94); the adjusting shaft (99) also rotatably mounted in the lever (98), the pinion (96) being attached to the adjusting shaft (99); an adjusting motor (100) having a shaft (99) suspended on the assembly lever (98); and an elongated elastic link (101) movably connecting an elongated section of this assembly lever (98) to the frame (70).

6. The screen printing machine of claim 2, wherein the slip-free transmission from the intermediate shaft to the stencils and to the supporting belt comprises two pulleys connected in non-slip relation by a toothed belt, the pulley for the supporting belt being bearing-mounted on the intermediate shaft so as to rotate freely on the intermediate shaft, and a magnetic toothed coupling fixed on the intermediate shaft and selectively operable for either non-slip engagement with or disengagement from the pulley for the supporting belt.

7. The screen printing machine of claim 4, wherein the supporting belt passes around a drive roller, one end of the drive roller being self-adjustably mounted in bearings and the other end of the drive roller being carried by the drive box which is supported in the frame, so that the supporting belt can tilt about a line transversely on the roller in the main frame of the machine.

8. The screen printing machine of claim 5, further comprising an auxiliary motor connected, via a free-wheel clutch, to the exit shaft of the gear drive, the auxiliary motor being provided with a pulsating excitation during shifting to another gear ratio for synchronizing the sliding claw couplings of the variable gear drive.

9. The screen printing machine of claim 1, wherein the common adjusting means for determining the level of the horizontal operative path section of the supporting belt comprises a series of cam faces which are coupled together and provided with a common adjustment device, each cam face interacting with a follower and a belt guiding device directly connected to the follower.

10. The screen printing machine of claim 9, wherein each cam face comprises a lowermost boundary of a groove in a strip, the boundary having a stepwise construction in which the strips are coupled together and said coupled strips are movably mounted in the main frame parallel to the horizontal operative path section of the supporting belt.

11. The screen printing machine of claim 9, wherein a pneumatic lifting device is provided between each follower interacting with a cam face and the associated belt guiding device and is constructed with two end positions for raising the belt guiding device to an operating position and lowering said device to a position in which the supporting belt is spaced from the stencils.

12. The screen printing machine of claim 10, wherein the adjustment device for the cam faces comprises a screw thread rod aligned with the coupled strips, the rod cooperating with a nut device which cannot move axially in the frame, a drive motor being present for rotating the nut device to adjust the cam faces.

13. The screen printing machine of claim 12, wherein each belt guiding device comprises a roller rotatably mounted at both ends, and wherein a set of coupled strips with cam faces is fitted on either side of the machine, a single drive motor provided to cooperate with the nut device of the thread rod associated with each set of coupled strips, via a toothed belt or chain.

14. The screen printing machine of claim 10, wherein the coupled strips are provided with a number of magnetic pulse emitters, and at least one sensor is provided in the frame for detecting the position of the strips and thereby fixing the position of all of the belt guiding devices.

15. The screen printing machine of claim 9, further comprising at least two return rollers for the supporting belt and means for supporting at least one of the two return rollers in a movable manner in the frame for tensioning and slackening the belt, said means for supporting the at least one movable return roller including a screw rod connected to two the ends of the movable roller, and on which a rotatably but axially nonmovable nut device is fitted and provided with a motor drive.

16. The screen printing machine of claim 15 further comprising a device for measuring the tensile stress in the screw rod, the device emitting a pulse for switching off the motor drive when the desired belt tension has been reached.

17. The screen printing machine of claim 1, wherein the two transverse extensions of one end of each transverse beam on one side of the machine are firmly fixed to the beam, and the two extensions at the other end of each beam on the other side of the machine are attached to a cradle which is slidably supported along the beam.

18. The screen printing machine of claim 17, further comprising means for axially moving the extensions on the other side of the machine to a limited extent relative to the cradle.

19. The screen printing machine of claim 17, further comprising means for axially moving each assembly head on the one side of the machine relative to the respective fixed extension.

20. The screen printing machine of claim 19, wherein at least three screwed spindles are axially mounted in each assembly head on the on side of the machine, said spindles being immovable with respect to the respective extension, and for each screwed spindle a nut is rotatably mounted in the assembly head, said nuts cooperating with a common drive source.

21. The screen printing machine of claim 17, wherein each assembly head on the other side of the machine is immovable relative to its respective extension in a direction transverse to the longitudinal direction of the beam, said extension being suspended from the cradle which is movable in the longitudinal direction of the beam.

22. The screen printing machine of claim 21, wherein each assembly head on the other side of the machine is mounted on a ring with at least three lugs, each lug containing a piston-cylinder device connected to an intermediate component slidable in the transverse direction for adjusting the perpendicular position of the associated stencil with respect to the direction of travel of the supporting belt.

* * * * *

UNITED STATES PATENT AND TRADEMARK OFFICE

CERTIFICATE OF CORRECTION

PATENT NO. : 4,909,143

DATED : 20 March 1990

INVENTOR(S) : R. Van den BERG et al.

It is certified that error appears in the above-identified patent and that said Letters Patent is hereby corrected as shown below:

| Column | Line | Corrections |
|---|---|---|
| 1 | 48 | After "invention" delete "a". |
| 1 | 55 | Change "NL 0511." to --NL 6910511.-- Before "transverse" insert --The--. |
| 3 | 48 | Change "tooting" to --toothing--. |
| 4 | 1 | Change "An embodiment" to --In an embodiment--. |
| 4 | 28 | Change "Object" to --An object--. |
| 5 | 60 | Change "had" to --head--. |
| 8 | 62 | Change "rotatably" to --rotatable--. |
| 8 | 66 | Change "an d82" to --and 82--. |
| 10 | 35 | Change "tooted" to --toothed--. |
| 12 | 59 | After "follower" delete "139". |
| 14 | 31-35 | After "adjusting" delete hard return and continue indent. |
| 15 | 13 | Change "concerning" to --corresponding--. |
| 15 | 36 | Change "ribs 175" to --ribs 176--. |
| 15 | 58 | Change "cylinders 178" to --cylinders 183--. |

UNITED STATES PATENT AND TRADEMARK OFFICE

CERTIFICATE OF CORRECTION

PATENT NO. : 4,909,143

DATED : 20 March 1990

INVENTOR(S) : R. Van den BERG et al.

It is certified that error appears in the above-identified patent and that said Letters Patent is hereby corrected as shown below:

| | | |
|---|---|---|
| 16 | 40 | After "shift" insert --of--. |
| 17 | 1 | Change "slidable" to --slidably--. |
| 17 | 12 | change "itself" to --themselves--. |
| 17 | 44 | Change "mainframe" to --main frame--. |
| 18 | 5 | After "for" delete "two coaxial". |
| 18 | 6 | After "comprises" insert --two coaxial--. |
| 18 | 12 | Replace "and" with --the--. |
| 20 | 3 | Change "two the" to --the two--. |
| 20 | 18 | Change "extensions" to --extension--. |
| 20 | 27 | Before "side" change "on" to --one--. |

Signed and Sealed this

Thirteenth Day of August, 1991

*Attest:*

*Attesting Officer*

HARRY F. MANBECK, JR.

*Commissioner of Patents and Trademarks*